US008165485B2

(12) United States Patent
Asakura et al.

(10) Patent No.: US 8,165,485 B2
(45) Date of Patent: Apr. 24, 2012

(54) FIXING APPARATUS HAVING HEATING ELEMENT AND IMAGE FORMING APPARATUS HAVING THE FIXING ELEMENT

(75) Inventors: Kenji Asakura, Kyoto (JP); Toshiaki Kagawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 633 days.

(21) Appl. No.: 12/343,049

(22) Filed: Dec. 23, 2008

(65) Prior Publication Data

US 2009/0169231 A1 Jul. 2, 2009

(30) Foreign Application Priority Data

Dec. 26, 2007 (JP) ..... 2007-335224

(51) Int. Cl.
*G03G 15/20* (2006.01)

(52) U.S. Cl. ..... 399/69; 399/67; 399/328; 399/329; 399/333; 399/334

(58) Field of Classification Search ..... 399/67, 399/69, 328, 329, 333, 334
See application file for complete search history.

(56) References Cited

U.S. PATENT DOCUMENTS

| | | | |
|---|---|---|---|
| 5,576,805 | A | 11/1996 | Ishihara et al. |
| 2003/0095812 | A1 | 5/2003 | Nagamori et al. |

FOREIGN PATENT DOCUMENTS

| | | | | |
|---|---|---|---|---|
| JP | 06-019347 | A | | 1/1994 |
| JP | 06-202513 | A | | 7/1994 |
| JP | 08-185014 | A | | 7/1996 |
| JP | 08-335000 | A | | 12/1996 |
| JP | 10-186800 | A | | 7/1998 |
| JP | 2001-051544 | A | | 2/2001 |
| JP | 2003-156920 | A | | 5/2003 |
| JP | 2004-022285 | A | | 1/2004 |
| JP | 2004234997 | A | * | 8/2004 |
| JP | 2006-350241 | A | | 12/2006 |

OTHER PUBLICATIONS

English Translation of JP2004-234997 to Taniguchi.*

* cited by examiner

*Primary Examiner* — Ryan Walsh
(74) *Attorney, Agent, or Firm* — Birch, Stewart, Kolasch & Birch, LLP

(57) ABSTRACT

A fixing apparatus includes a heating element with an NTC characteristic in which an electric resistance value decreases as a temperature increases, which extends (i) in a direction parallel to a recording paper and (ii) in a width direction perpendicular to a carrying direction of the recording paper, and which has a longer length, in the width direction, than a width of the recording paper. The fixing apparatus further includes electrode sections provided in close proximity to both ends of the heating element in the width direction), the electrode sections being connected to the heating element, so that a current flows in the heating element in a direction substantially perpendicular to the carrying direction of the recording paper. This makes it possible to restrain excessive increase in temperature at the both ends of the heating element and to obtain a uniform temperature distribution.

13 Claims, 14 Drawing Sheets

FIXING APPARATUS HAVING HEATING ELEMENT AND IMAGE FORMING APPARATUS HAVING THE FIXING ELEMENT

This Nonprovisional application claims priority under U.S.C. §119(a) on Patent Application No. 335224/2007 filed in Japan on Dec. 26, 2007, the entire contents of which are hereby incorporated by reference.

FIELD OF THE INVENTION

The present invention relates to an image forming apparatus such as a copying machine, a facsimile, a laser printer, and a multifunction printer, more specifically, to a fixing apparatus in an image forming section.

BACKGROUND OF THE INVENTION

Conventionally, an image forming apparatus such as a copying machine and a facsimile has broadly adopted an electrophotographic method. The image forming apparatus adopting the electrophotographic method forms a toner image by developing a latent image that is formed on an image bearing member, and electrostatically transfers the toner image to a transfer material. The toner image thus transferred to the transfer material is heated and pressed in a fixing apparatus so that the toner image is fixed on the transfer material.

On the contrary, Patent Document 1 discloses that a resistive element having a positive temperature coefficient (PTC) characteristic is used as a heating element of a fixing apparatus, and a heating voltage is applied to the resistive element in a direction perpendicular to a carrying direction of a recording paper. The positive temperature coefficient is a characteristic in which a resistance value linearly increases as a temperature increases. In other words, as the temperature becomes high, the resistance value also becomes high.

[Patent Document 1] Japanese Unexamined Patent Publication No. 2006-350241 (published on Dec. 28, 2006)

However, a temperature increases in an area where the recording paper does not pass, because heat does not transfer to the recording paper in the area. In the arrangement disclosed in Patent Document 1, such the state causes a resistance value to increase in the area where the recording paper does not pass, because the heating element has the PTC characteristic. In the state where the resistance value has increased in the area where the recording paper does not pass, when a current is applied perpendicularly to a carrying direction of the recording paper, a high resistance part where the recording paper does not pass is connected in series with a low resistance part where the recording paper passes. In such a series circuit, the same current flows in the high resistance part where the recording paper does not pass and in the low resistance part where the recording paper passes. Therefore, a heat value is higher in the high resistance part where the recording paper does not pass than in the low resistance part where the recording paper passes. This causes a problem in which a difference in temperature distribution becomes larger between the area where the recording paper does not pass and the area where the recording paper passes. This worsens endurances of members provided in the area where the recording paper does not pass. Further, it becomes difficult to obtain a uniform and high-quality fixed image on a wide-width paper that is processed immediately after processing of narrow-width papers at high throughput.

SUMMARY OF THE INVENTION

The present invention is accomplished in view of the above problems. An object of the present invention is to provide a fixing apparatus which can improve endurances of members provided in an area where a recording paper does not pass, and which can provide a uniform and high-quality fixed image on a wide-width recording paper that is processed immediately after processing of narrow-width recording papers at high throughput.

In order to achieve the above object, a fixing apparatus of the present invention in which fixing is carried out by heat generated from a heating element while a power is being supplied thereto, and a power supplied to the heating element is controlled so that the heating element has a predetermined temperature during the fixing, includes: a fixing belt that comes into contact with a surface of a recording paper to be carried in a predetermined carrying direction, on which surface an unfixed toner image is borne; a pressure member that is depressed by the fixing belt via the recording paper; and a plurality of support members provided inside the fixing belt so as to support the fixing belt. In such the fixing apparatus, the heating element has an NTC characteristic in which an electric resistance value decreases as a temperature increases, the heating element extends (i) in a direction parallel to the recording paper and (ii) in a width direction perpendicular to the carrying direction of the recording paper, and the heating element has a longer length, in the width direction, than a width of the recording paper. The fixing apparatus further includes electrode sections provided on respective inner surface sides in close proximity to both ends, in the width direction, of the heating element, the electrode sections being connected to the heating element, a current being supplied to the heating element so as to direct from one of the electrode sections toward the other one of the electrode sections provided on the respective inner surface sides in close proximity to the both ends.

Additional objects, features, and strengths of the present invention will be made clear by the description below. Further, the advantages of the present invention will be evident from the following explanation in reference to the drawings.

DESCRIPTION OF THE INVENTION

Embodiment 1

One embodiment of the present invention is explained below with reference to FIGS. 1 through 6.

(1-1 Color Image Forming Apparatus)

Figure 2:
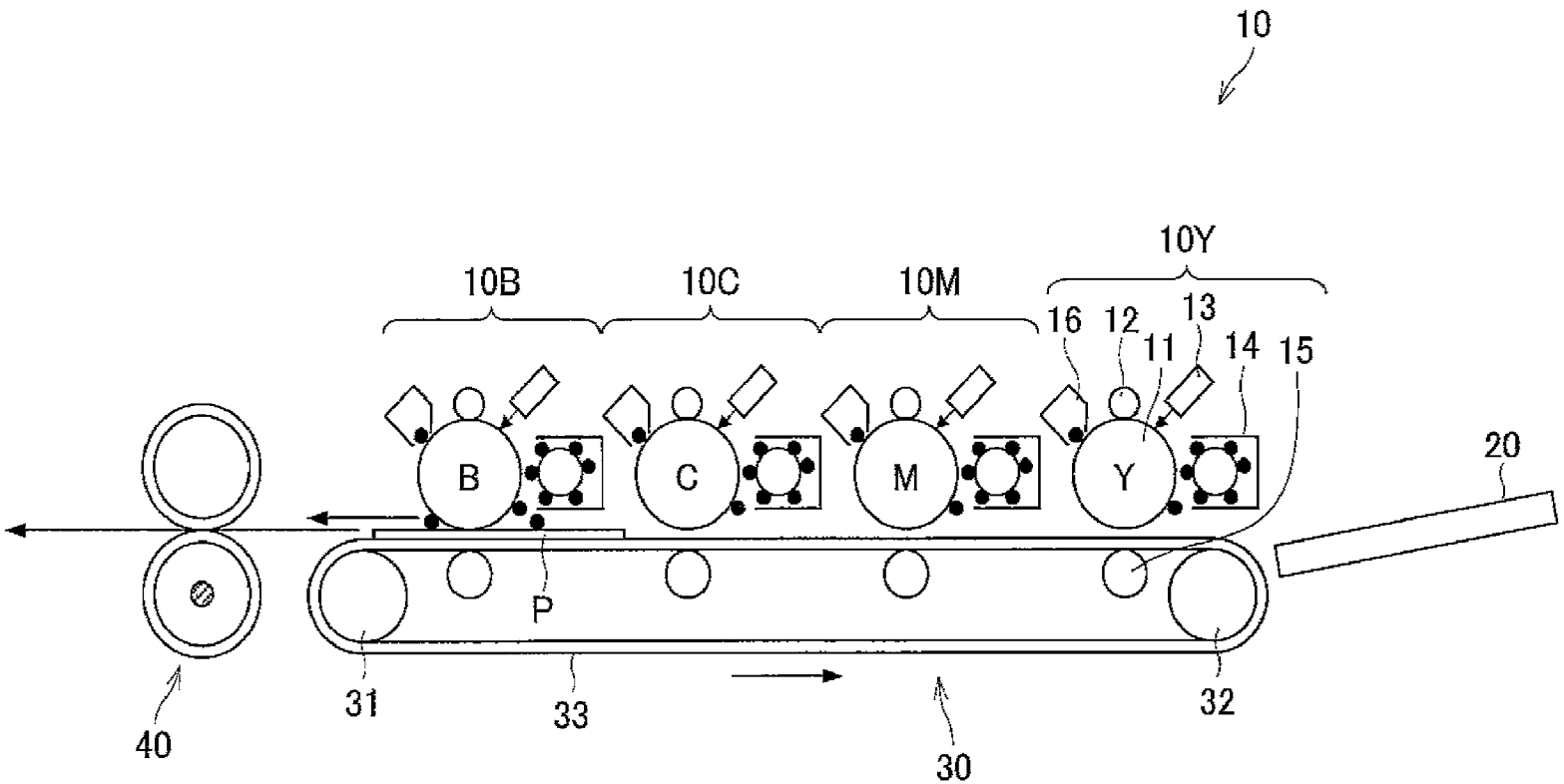
FIG. 2 illustrates a color image forming apparatus to which a fixing apparatus of Embodiment 1 of the present invention is applied.

FIG. 2 illustrates a color image forming apparatus to which a fixing apparatus 40 of Embodiment 1 of the present invention is applied. As illustrated in FIG. 2, the color image forming apparatus is so-called a tandem type printer in which four visible image forming units 10 for four colors are provided along a recording medium carrying path. More specifically, four visible image forming units 10Y, 10M, 10C, and 10B are provided along a carrying path of a recording paper P, which carrying path is provided between a feeding tray 20 of the recording paper P (a material to be heated) and the fixing apparatus 40. Toner images corresponding to four colors are transferred to the recording paper P that is carried by an endless carrying belt 33 of recording paper carrying means 30 such that the toner images overlap each other. The toner images thus transferred are fixed on the recording paper P by the fixing apparatus 40. As such a full color image is formed.

The recording paper carrying means 30 includes the endless carrying belt 33 that is suspended by a pair of a driving roller 31 and an idling roller 32 and is controlled to rotate at a predetermined peripheral speed. A recording paper P is electrostatically adsorbed to the carrying belt 33 and transferred.

Each of the visible image forming units 10 is arranged such that a charging roller 12, laser light irradiation means 13, a developing unit 14, a transfer roller 15, and a cleaner 16 are provided around a photoreceptor drum 11. Developing units 14 of the visible image forming units 10 respectively contain a yellow (Y) toner, a magenta (M) toner, a cyan (c) toner, and a black (B) toner. The toners are a developer (hereinafter, also referred to as a toner) such as a nonmagnetic monocomponent developer (nonmagnetic toner), a nonmagnetic bicomponent developer (nonmagnetic toner and carrier), and a magnetic developer (magnetic toner).

Each of the visible image forming units 10Y, 10M, 10C, and 10B forms a toner image on a recording paper P according to the following processes. That is, the charging roller 12 uniformly charges a surface of the photoreceptor drum 11, and the laser light irradiation means 13 exposes the charged surface of the photoreceptor drum 11 according to image information, so as to form an electrostatic latent image on the photoreceptor drum 11. The developing unit 14 develops the electrostatic latent image formed on the photoreceptor drum 11 with the toner so as to form a toner image. A bias voltage whose polarity is opposite to the toner is applied to the transfer rollers 15, and the transfer roller 15 transfers the toner image thus visualized onto the recording paper P carried by the carrying means 30. As such, each toner image is sequentially transferred onto the recording paper P.

Then, the recording paper P is detached from the carrying belt 33 due to a curvature of the driving roller 31, and is carried to the fixing apparatus 40. In the fixing apparatus 40, a fixing roller that maintains a predetermined temperature applies appropriate temperature and pressure to the recording paper P. As such, the toner is fixed on the recording paper P as a rigid image.

(1-2 Fixing Apparatus of Image Forming Apparatus)

Figure 3:
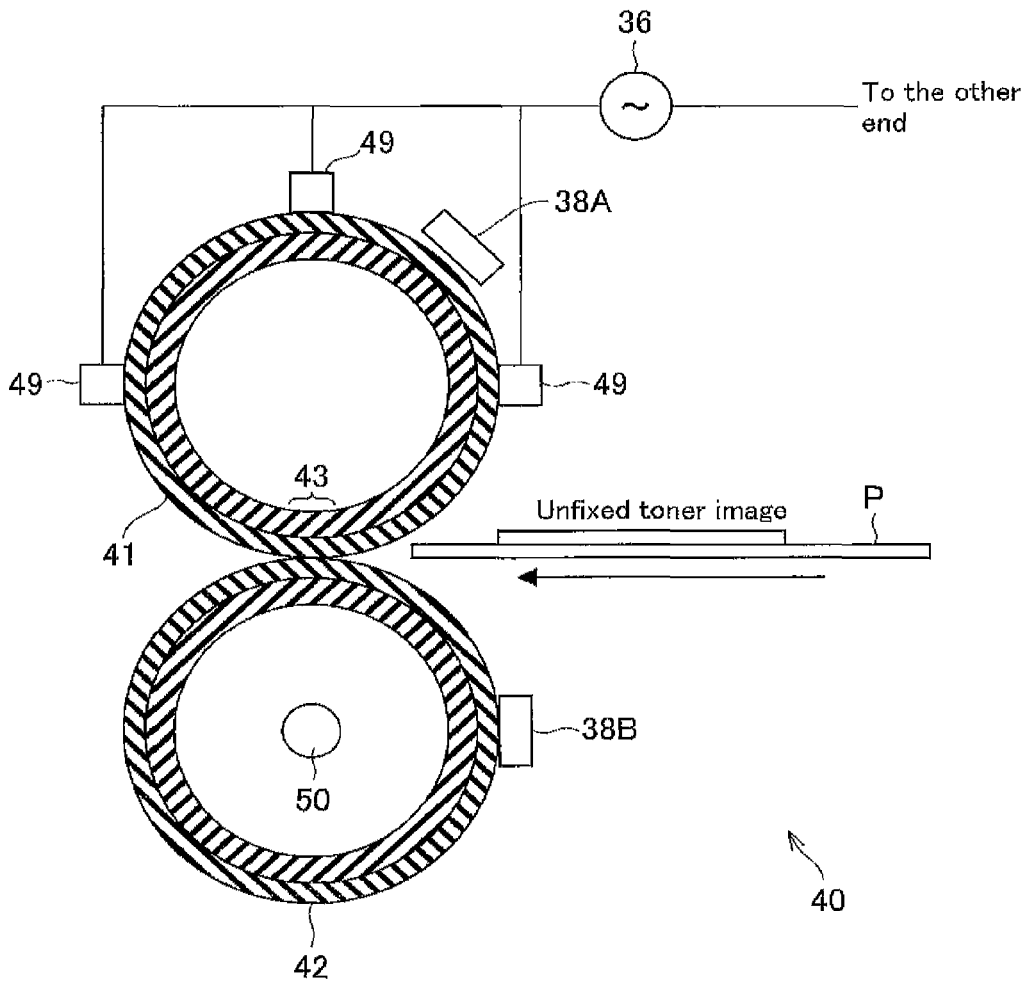
FIG. 3 is a cross sectional view illustrating an arrangement of the fixing apparatus according to Embodiment 1 of the present invention.

The following explains about an arrangement of the fixing apparatus 40 of the present embodiment of the invention with reference to FIG. 3.

The fixing apparatus 40 of the present embodiment fixes, by heat and pressure, an unfixed toner image that has been formed on a surface of a recording paper P, onto the recording paper P. The unfixed toner image is formed by a developer (hereinafter, referred to as a toner) such as a nonmagnetic monocomponent developer (nonmagnetic toner), a nonmagnetic bicomponent developer (nonmagnetic toner and carrier), and a magnetic developer (magnetic toner).

FIG. 3 is a cross sectional view illustrating an arrangement of the fixing apparatus 40 according to the present embodiment. As illustrated in FIG. 3, the fixing apparatus 40 of the present embodiment includes a fixing roller 41 as a fixing member for forming a fixing nip area 43, and a pressure roller 42 as a pressure member that is pressed by the fixing member via a recording paper P. The fixing apparatus 40 further includes temperature sensors (temperature detecting members) 38A and 38B that respectively detect temperatures of the fixing roller 41 and the pressure roller 42.

The fixing roller 41 and the pressure roller 42 are pressed against each other with a predetermined load (300N in this arrangement), and the fixing nip area 43 (a part where the fixing roller has contact with the pressure roller) is formed therebetween. A recording paper P passes through the fixing nip area 43 so that a toner image is fixed thereon. When the recording paper P passes through the fixing nip area 43, the fixing roller 41 has contact with a surface of the recording paper P, on which surface an unfixed toner image is formed. At this time, the pressure roller 42 has contact with another surface of the recording paper P, opposite to the surface on which the unfixed toner image is formed.

Figure 1:
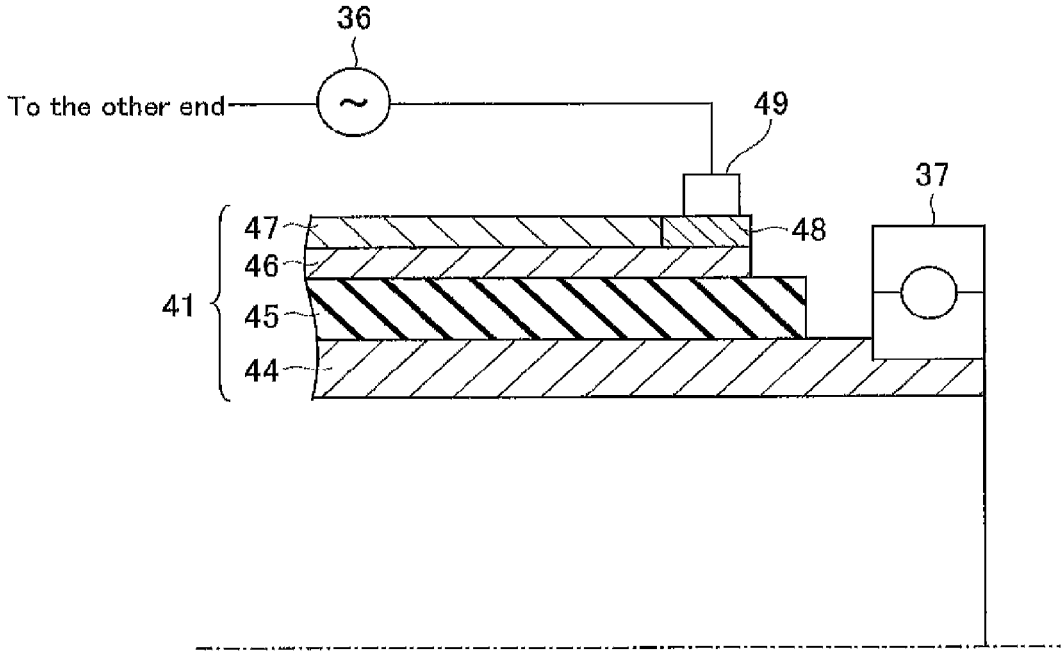
FIG. 1 is a cross sectional view illustrating an arrangement of an end of a fixing roller, including a rotational axis, according to Embodiment 1 of the present invention.

The following schematically explains about details of an arrangement of the fixing roller 41 of the fixing apparatus 40 of the present embodiment, with reference to FIG. 1. FIG. 1 is a cross sectional view illustrating an arrangement of an end of the fixing roller 41, including a rotational axis.

As illustrated in FIG. 1, the fixing roller 41 is arranged such that a thin roller metal core 44 having a thickness of 0.8 mm, an insulating layer 45 made of a silicon rubber layer having a thickness of 500 μm, which silicon rubber layer has a heat insulation property and elasticity, a heat-generating layer 46 (heating element) having a thickness of 200 μm, and a releasing layer 47 made of a fluorine resin layer, such as PTFE or PFA, having a thickness of 30 μm are laminated sequentially in this order.

The fixing roller 41 is provided parallel to the recording paper P, and extends in a direction perpendicular to a carrying direction of the recording paper P (in the Description, referred to as a width direction). The fixing roller 41 has a longer length, in a width direction, than a width of the recording paper (a length in a direction perpendicular to the carrying direction).

In the present embodiment, the roller metal core 44 is an iron metal core, but is not limited to this. The roller metal core may be made from, for example, iron, stainless steel, aluminum, or an alloy of them. A bearing 37 is provided at either end of the roller metal core 44.

As has been already described, the insulating layer 45 is made from a silicon rubber having a heat insulation property and elasticity, but is not limited to this and may be made from a fluoro-rubber.

The heat-generating layer 46 has an NTC (Negative Temperature Coefficient) characteristic. The NTC characteristic is a characteristic in which a resistance value decreases as a temperature increases. That is, as the temperature becomes high, the resistance value becomes low. The heat-generating layer 46 is arranged so that a resistance value between electrodes is 10Ω, so as to obtain a heat value of 1000 W at 10V. The resistance value of the heat-generating layer 46 is preferably 5 through 60Ω, and further preferably 8 through 45Ω. The resistance value of the heat-generating layer 46 is determined by a voltage to be applied and a predetermined electric power for heat generation.

The releasing layer 47 is preferably made from a fluorine resin such as PFA (copolymer of tetrafluoroethylene and perfluoroalkylvinylether) or PTFE (polytetrafluoroethylene), or a mixed material thereof.

The insulating layer 45, the heat-generating layer 46, and the releasing layer 47 are laminated, in this order, on a surface of the roller metal core 44, so as to be parallel to a recording paper and extend to a width direction perpendicular to the carrying direction of the recording paper P.

Further, as illustrated in FIG. 1, electrode sections 48 made from a good conductive material such as copper or aluminum are respectively provided in close proximity to both ends of the fixing roller 41 as power supplying means in an entire circumferential direction, and a plurality of electric contact points 49 are provided so as to slide in contact with the electrode sections 48 so that a power is supplied to the electrode sections 48. In the arrangement, the power is supplied to the electrode sections 48 in an axial direction of the fixing roller 41, i.e., a direction perpendicular to the carrying direction of the recording paper P.

The electrodes sections 48 are provided on respective outer surface sides in close proximity to the both ends (areas where a recording paper does not pass) of the heat-generating layer 46 in the width direction, the electrode sections 48 being connected to the heat-generating layer 46. The releasing layer 47 is not laminated on the electrode sections 48 so that the electrode sections 48 are connected to a power supply 36 via the plurality of the electric contact points 49. A power is supplied to the electrode sections 48 respectively provided in close proximity to the both ends of the heat-generating layer 46 in the width direction so that a current flows between the electrode sections 48. As a result, the heat-generating layer 46 is electrified as such in a direction substantially perpendicular to the carrying direction of the recording paper P. An area where a recording paper passes means an area that faces the recording paper to be carried, and the area where the recording paper does not pass means areas other than the area where the recording paper passes.

While the power is being supplied to the heat-generating layer 46, a temperature of the heat-generating layer 46 increases so that the heat-generating layer 46 heats a surface of the fixing roller 41 by thermal conduction. In the heat-generating layer 46, a part between the two electrode sections respectively provided in close proximity to the both ends of the fixing roller 41, substantially serves for generating heat. The heat-generating layer 46 (a width between the electrode sections) of the fixing roller 41 has a width of 330 mm, and an A3-size recording paper P, which has a maximum size as a recording paper P, has a lateral size of 297 mm (that is, a lateral size of an A3-size recording paper in longitudinal feed). On this account, the fixing apparatus 40 is capable of fixing an unfixed toner image with respect to plural types of recording papers having different widths in a direction perpendicular to the carrying direction, and the maximum width in the plural types of the recording papers is 297 mm. The width (i.e., the width between the electrode sections) of the heat-generating layer 46, which width serves as a heating element, is wider than the lateral size of the A3-size recording paper P.

In forming an image, the fixing roller 41 is heated so as to have a predetermined surface temperature (190° C. in the arrangement), and heats a recording paper P on which an unfixed toner image is formed, and which passes through the fixing nip area 43 of the fixing apparatus 40.

Moreover, a heater lamp 50 is provided inside the pressure roller 42 so that the heater lamp 50 heats the pressure roller 42 from inside. The heater lamp 50 has a heat-generating width that entirely covers a width of the pressure roller 42, and a rated power for heat generation is 450 W.

Similarly to the fixing roller 41, the pressure roller 42 includes (i) a roller metal core made from iron steel, stainless steel, aluminum, or the like, (ii) an elastic layer made from a silicon rubber or the like, provided on an outer surface of the roller metal core, and (iii) a releasing layer made from PFA or the like, provided on the elastic layer.

The following explains about the thermistors 38A and 38B. The thermistors 38A and 38B are provided respectively above an outer surface of the fixing roller 41 and on an outer surface of the pressure roller 42, and detect surface temperatures of the fixing roller 41 and the pressure roller 42.

The thermistor 38A is provided above a central part of the outer surface of the fixing roller 41 so that the thermistor 38A detects a surface temperature of the central part of the fixing roller 41. The thermistor 38B is provided on a surface of the pressure roller 42. Note that the thermistor 38A is a noncontact thermistor that is provided in the area where the recording paper passes, in the central part of the fixing roller 41. Based on data of temperatures detected by the thermistors 38A and 38B, a control circuit (not shown) as temperature control means controls a power supplied respectively to the heat-generating layer 46 and to the heater lamp 50 of the pressure roller 42 so that the rollers has a predetermined temperature. Note that, the heat-generating layer 46 of the fixing roller 41 and the heat lamp 50 are electric circuits that are independent to each other.

Further, a driving motor (driving means) for driving the fixing roller 41 to rotate is provided so that the recording paper P passes through the fixing nip area 43 (not shown in FIG. 3). The pressure roller 42 is driven to rotate by a rotation of the fixing roller 41. The fixing roller 41 rotates in a direction opposite to a rotational direction of the pressure roller 42 (at the fixing nip area, both rollers move in the same direction). A recording paper P on which an unfixed toner image is formed is carried at a predetermined fixing speed and a copy speed (the fixing speed means a so-called process speed, and is, for example, 200 mm/sec in the arrangement, and the copy speed means the number of sheets copied per minute, and is, for example in the arrangement, 30 sheets/min in a case of an A4-size sheet by cross feed), and the unfixed toner image is fixed by heat and pressure.

(1-3 Heat Generation Characteristic by Supplying Power to Heat-Generating Layer of the Present Invention)

Figure 4:
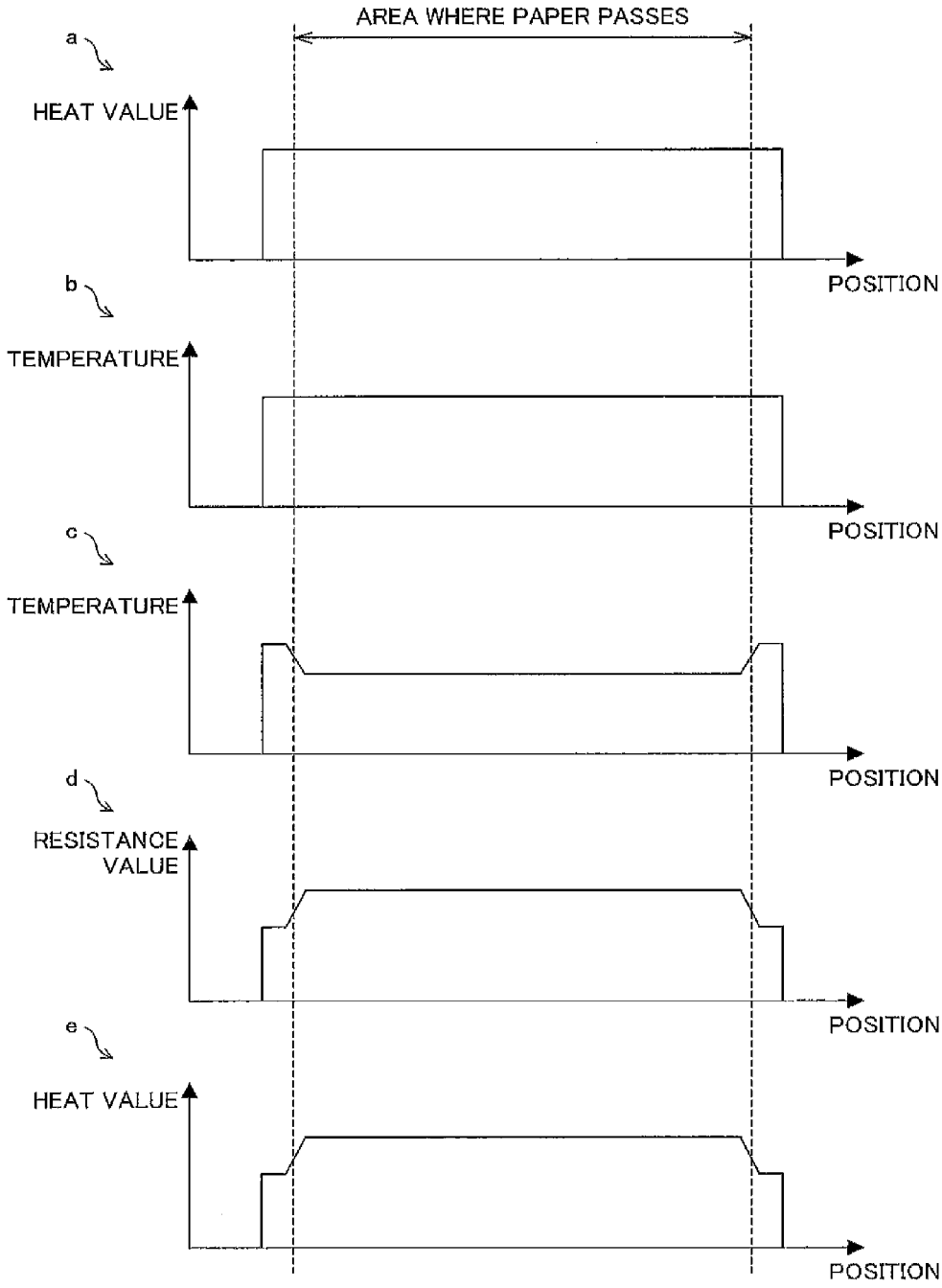
FIG. 4 shows distributions of heat values, temperatures, and a resistance value, each in a part between electrode sections in a heat-generating layer in a width direction and in an area where a recording paper passes, in an outer surface of the fixing roller according to Embodiment 1 of the present invention.
Figure 5:
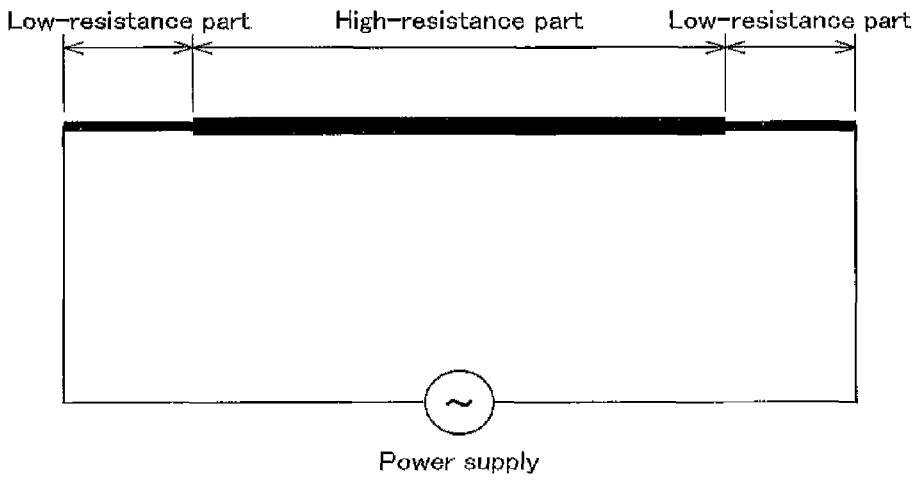
FIG. 5 schematically illustrates application of a current to a series circuit in which high-temperature and low-resister parts at both ends of a fixing roller are connected in series with a low-temperature and high resistance part at a center of the fixing roller.

Explained below with reference to FIGS. 4 and 5 is how to control heat, by use of that heat-generating layer 46 of the present invention which has the NTC (Negative Temperature Coefficient) characteristic.

FIG. 4 shows distributions of heat values, temperatures, and a resistance value, each in a part between the electrode sections 48 in the heat-generating layer 46 in a width direction and in an area where a recording paper passes, in an outer surface of the fixing roller 41.

In FIG. 4, a graph a shows a heat generation distribution of the heat-generating layer 46 in a width direction (in a direction parallel to an axial direction of the fixing roller 41), which distribution is before a recording paper P passes. A graph b shows a temperature distribution of the heat-generating layer 46 in the width direction, which distribution is before the recording paper P passes. A graph c shows a temperature distribution of the heat-generating layer 46 in the width direction, which distribution is after the recording paper P passed. A graph d shows a resistance distribution of the heat-generating layer 46 in the width direction, which distribution is after the recording paper P passed. A graph e shows, in the width direction, a heat generation distribution of the heat-generating layer 46 that is electrified so as to have the resistance distribution shown in the graph d.

As shown in the graph a of FIG. 4, the heat generation distribution is substantially uniform in the width direction of the heat-generating layer 46 before a recording paper passes. Since heat values of the heat-generating layer 46 are uniform in the width direction as such, the temperature distribution is substantially uniform as shown in the graph b of FIG. 4. When the recording paper P passes through the fixing apparatus 40, heat does not shift from the fixing roller 41 to the recording paper P in areas where the recording paper P does not pass (both ends of the fixing roller), but heat shifts from the fixing roller 41 to the recording paper P in the area where the recording paper P passes (a center of the fixing roller). From this reason, a temperature in the area where the recording paper P passed decreases as shown in the graph c of FIG. 4. In the present invention, the heat-generating layer 46 is a heating element having the NTC characteristic. On this account, in a case where such the temperature distribution occurs, a resistance value becomes low in a part where a temperature is high, and a resistance value becomes high in a part where a temperature is low, as shown in the graph d of FIG. 4. As schematically illustrated in FIG. 5, this status is a series connection circuit in which the part where the temperature is relatively high and the resistance value is low (a high-temperature and low-resistance part) is connected in series with the part where the temperature is relatively low and the resistance value is high (a low-temperature and high-resistance part). That is, when a current is applied, in a width direction, to the heat-generating layer having the NTC characteristic, in which heat-generating layer such the temperature distribution occurs in the width direction, the high-temperature and low-resistance part is electrically connected in series with the low-temperature and high-resistance part, as shown in FIG. 5. This means that, in this status, the same current flows into the high-temperature and low-resistance part and the low-temperature and high-resistance part. In this case, when a temperature is controlled by the temperature sensor including the thermistor 38A provided in the area where the recording paper P passes, it is possible to cause the heat value to be relatively low in the high-temperature and low-resistance part, compared with the low-temperature and high-resistance part, as shown in the graph e of FIG. 4. This can decrease unevenness in temperature caused in the width direction, and prevent that the temperature becomes too high at the both ends of the fixing roller 41.

Figure 6:
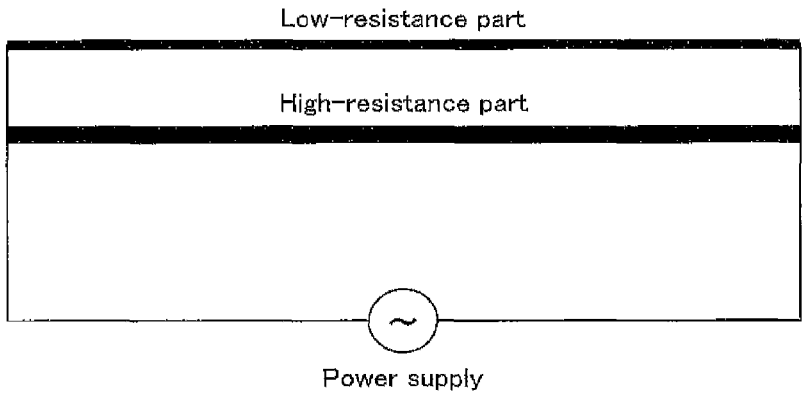
FIG. 6 schematically illustrates application of a current to a parallel circuit in which high-temperature and low-resistance parts at both ends of a fixing roller are connected in parallel with a low-temperature and high-resistance part at a central part of the fixing roller.

On the other hand, in a case where a current is applied parallel to the carrying direction of the recording paper P, the current flows into a parallel circuit in which the high-temperature and low-resistance part at the both ends of the fixing roller is electrically connected in parallel with the low-temperature and high-resistance part at the center of the fixing roller, as schematically illustrated in FIG. 6. In this case, application of the same voltage to the parallel circuit causes more current to flow into the high-temperature and low-resistance part, thereby resulting in that the temperature in the high-temperature and low-resistance part increases more and unevenness in temperature becomes more significant.

Further, since the heat-generating layer 46 between the electrode sections (i.e., a part that substantially generates heat) has a longer length, in the width direction perpendicular to the carrying direction of the recording paper P, than a maximum width (length in a direction perpendicular to the carrying direction) of the recording paper P that can be printed by the image forming apparatus, it is possible to heat the area where the recording paper P passes at a uniform temperature, with the result that a uniform and high-quality fixed toner image can be obtained. Furthermore, since the thermistor 38A is provided in the area where the recording paper P passes, it is possible to directly control the temperature in the area where the recording paper P passes, with high accuracy. As a result, it is possible to stably obtain a high-quality fixed toner image. Moreover, the current flows in the heat-generating layer entirely in a direction substantially perpendicular to the carrying direction, thereby resulting in that it is possible to restrain unevenness in temperature in the width direction and to obtain a uniform and high-quality toner fixed image.

Further, the electrode sections 48 are provided in an entire circumferential direction, so that a whole area of the heat-generating layer can uniformly generate heat, thereby causing no unevenness in heat in the circumferential direction and realizing a uniform temperature distribution in the circumferential direction.

Moreover, the electrode sections 48 via which a current is applied to the heat-generating layer 46 are respectively provided at one of the areas where the recording paper does not pass and the other one of the areas, in the heat-generating layer in the width direction. This makes it possible to cause the current to flow, in the heat-generating layer, in a direction perpendicular to a direction in which the recording paper P passes. Since the current flows as such in the heat-generating layer entirely in a direction substantially perpendicular to the carrying direction of the recording paper P, it is possible to restrain unevenness in temperature in the width direction of the heat-generating layer and to obtain a uniform and high-quality fixed toner image.

Further, the heat-generating layer 46 is provided on an outer side of a core material in the fixing roller 41. This shortens a heat conduction distance from the heat-generating layer 46 to a surface of the releasing layer 47, which surface is a fixing surface that comes into contact with a toner image. As a result, a temperature controllability according to heat generated from the heat-generating layer 46 can be improved in the surface of the fixing roller, so that it is possible to control the temperature in the surface of the fixing roller 41 with higher accuracy. This allows a fixed toner image to be a more uniform and higher-quality image.

Generally, when a heat conduction distance is short and a heat response is high, unevenness in temperature easily becomes significant between the area where the recording paper P passes and the areas where the recording paper P does not pass. However, in the present invention, a current is applied to the heat-generating layer having the NTC characteristic, in a direction perpendicular to the carrying direction of the recording paper P. This can prevent that the temperature excessively increases in the areas where the recording paper P does not pass.

Furthermore, the releasing layer 47 constitutes a surface of the fixing roller 41 such that the releasing layer 47 is provided outside the heat-generating layer 46, which surface comes into contact with a toner image. This can prevent that a toner adheres to the fixing roller 41.

The heat-generating layer 46 has a higher electric resistance than a metal material, such as aluminum and iron, which is commercially available at a low price and has high strength. Therefore, in a case where the heat-generating layer has direct contact with a roller metal core, a current flows into not the heat-generating layer but the roller metal core and the heat-generating layer does not generate heat. However, in the present embodiment, the insulating layer 45 made of a rubber layer is provided between the roller metal core 44 and the heat-generating layer 46, thereby preventing the current from flowing into the roller metal core 44 when a voltage is applied to the heat-generating layer 46, so that the heat-generating layer 46 is caused to generate heat. On this account, it is possible to use, for the roller metal core 44, a metal material such as aluminum and iron, which is commercially available at a low price and has high strength.

The electrode sections 48 are respectively provided on outer surfaces in close proximity to the both ends of the heat-generating layer 46 in the fixing roller 41, the electrode sections 48 being connected to the heat-generating layer 46. The releasing layer 47 is not laminated on the electrode sections 48 so that a current is supplied to the electrode sections 48 from a main body of an image forming apparatus via the plural electric contact points 49 as sliding contacts. This allows the current to flow in the heat-generating layer 46 in the fixing roller 41 in a roller axial direction that is perpendicular to the carrying direction of the recording paper P.

The present embodiment describes a color image forming apparatus in which an insulating layer (an elastic layer) having elasticity is used in a fixing roller. However, the fixing apparatus of the present embodiment is also applicable to a mono-color image forming apparatus that uses a single color toner, in which apparatus a hard roller in which no elastic layer is provided and a releasing layer is formed on a metal core is used as a fixing roller.

Further, if an insulating layer that is made from, for example, a fluorine resin, polyimide, polyamide, or the like, or an insulating layer that is made from a combination thereof is provided below a heat-generating layer, the heat-generating layer can be provided below an elastic layer such as a silicon rubber layer. In this case, since the heat-generating layer is not deformed due to deformation of rubber, it is possible to improve an endurance of the heat-generating layer.

Embodiment 2

In the present embodiment, in order to explain different points from Embodiment 1, members having the same functions as those explained in Embodiment 1 have the same referential numerals, and are not explained in the present embodiment.

Figure 7:
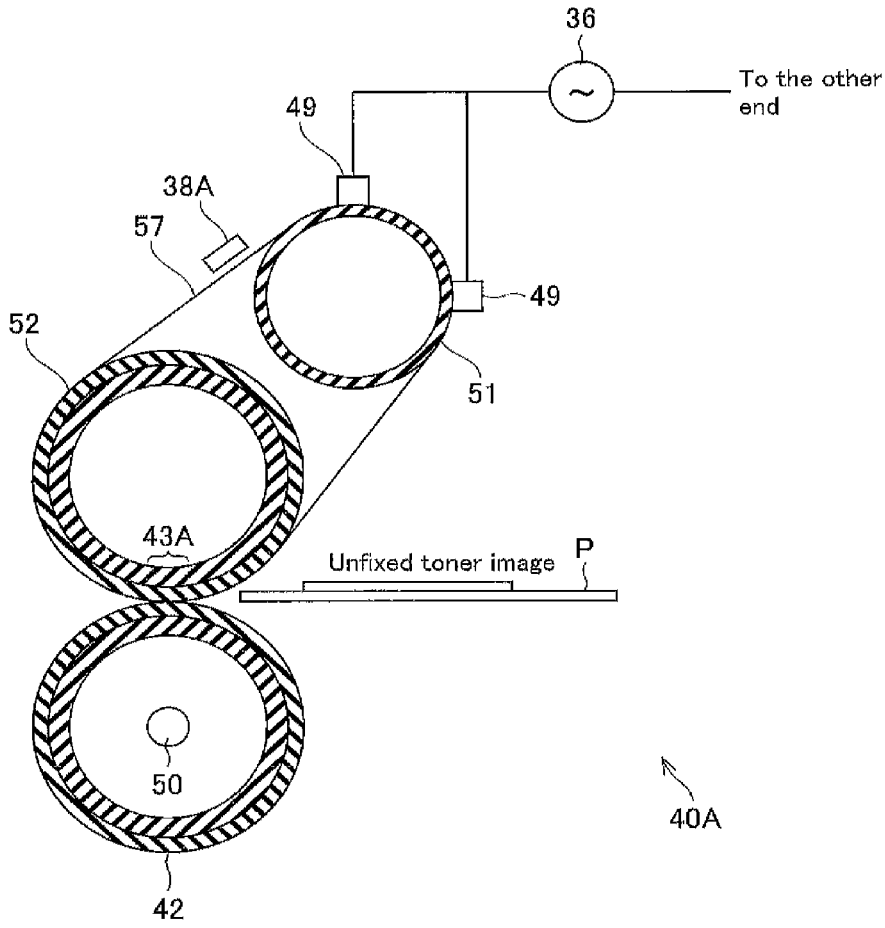
FIG. 7 is a cross sectional view illustrating an arrangement of a fixing apparatus, in an axial direction of a fixing belt, according to Embodiment 2 of the present invention.
Figure 8:
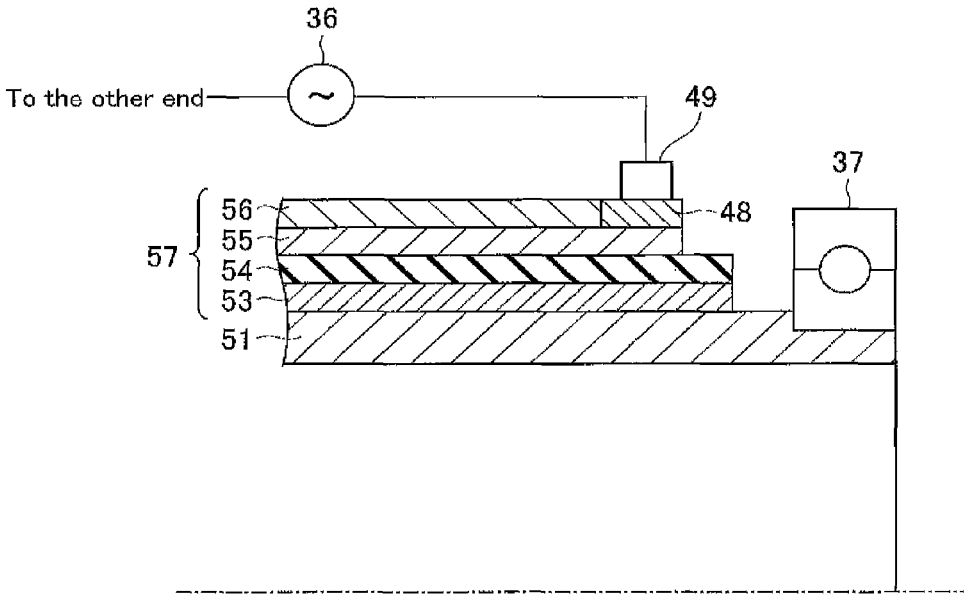
FIG. 8 is a cross sectional view illustrating an end of a fixing belt, including an axis, according to Embodiment 2 of the present invention.

Explained with reference to FIGS. 7 and 8 is a fixing apparatus 40A of the present embodiment, which is applied to a color image forming apparatus.

FIG. 7 is a cross sectional view illustrating the fixing apparatus 40A in an axial direction of a fixing belt 57, and FIG. 8 is a cross sectional view illustrating an end of the fixing belt 57, including an axis.

As illustrated in FIG. 7, the present embodiment is different from Embodiment 1 in that a thin fixing belt 57 is used as a fixing member that forms a fixing nip area 43A and comes into contact with a toner image. The other arrangements except for the above difference are the same as those in Embodiment 1.

The fixing belt 57 is supported by support members of (i) a first support roller 51 that tenses the fixing belt 57 to a predetermined degree and (ii) a second support roller 52 as a backup roller that pressures a pressure roller 42 via the fixing belt 57. Further, a noncontact thermistor 38A is provided, as temperature detecting means, so as to face a part in an outer surface of the fixing belt 57, which part is suspended between the support rollers 51 and 52, and a power supplied to the heat-generating layer 55 is controlled so that a temperature of the outer surface of the belt is maintained at 190° C. during image forming operation.

As illustrated in FIG. 8, the fixing belt 57 includes a substrate 53 which is made from polyimide and has a thickness of 90 μm, an insulating layer 54 which is made of a silicon rubber layer and has a thickness of 200 μm, a heat-generating layer 55 which has an NTC characteristic and a thickness of 200 μm, a releasing layer 56 which is a fluorine resin layer made from PTFE or PFA and provided as a surface layer, such that they are laminated sequentially in this order. Further, as illustrated in FIG. 8, electrode sections 48 made from an electrical conductor such as a metal are respectively provided in close proximity to both ends of the fixing belt 57 by printing or the like in an entire circumferential direction. The electrode sections 48 are provided on respective outer surface sides in close proximity to the both ends of the heat-generating layer 55 in a width direction, the electrode section being connected to the heat-generating layer 55. The releasing layer 56 is not laminated on the electrode sections 48 so that the electrode sections 48 are connected to a power supply 36 via electric contact points 49. That is, the power supply 36 is connected to the heat-generating layer 55 via the electric contact points 49 and the electrode sections 48. The electrode sections 48 can be also formed in such a manner that the both ends of the heat-generating layer 55 are coated with polyimide in which a metal powder is dispersed. Then, a power is supplied to the electrode sections 48 provided in close proximity to the both ends of the heat-generating layer 55 in the width direction so that a current flows between the electrode sections 48. As a result, the heat-generating layer 55 is electrified in a direction substantially perpendicular to a carrying direction of a recording paper P.

The first support roller 51 is formed by use of a thin aluminum pipe of 0.3 mm in thickness. The second support roller 52 is arranged such that a sponge layer of 5 mm in thickness made from silicon rubber foam is laminated on a metal core made from aluminum.

The electric contact points 49 slide in contact with the electrode sections 48 and supply a power to the electrode sections 48 in a part, in the fixing belt 57, wound around the first support roller 51. In FIG. 7, a plurality of the electric contact points 49 are provided so as to supply a power to the heat-generating layer 55 in an axial direction of the fixing belt, that is, in a direction perpendicular to a carrying direction of a recording paper P. The power supplied to the heat-generating layer 55 increases a temperature in the heat-generating layer 55, and a surface of the fixing belt 57 is heated due to heat conduction. The heat-generating layer 55 of the fixing belt 57 has a length of 320 mm, which is wider than a width of 297 mm of an A3-size recording paper. The heat-generating layer 55 that slides in contact with the electrode sections 48 has a resistance value of 10Ω so as to obtain a heat value of 1000 W at 100V. The resistance value is preferably 5 through 60Ω, and further preferably 8 through 45Ω. The resistance value is determined by a voltage to be applied and a predetermined electric power for heat generation.

Further, the noncontact thermistor 38A is provided, as temperature detecting means, on the part, in the outer surface of the fixing belt 57, suspended between the support rollers 51 and 52, such that the noncontact thermistor 38A faces the fixing belt 57, and a power supplied to the heat-generating layer 55 is controlled so that a temperature of the outer surface of the belt is maintained at 190° C. during operation of image forming. The fixing belt 57 has a small heat capacity and a high heat response. This makes it possible to maintain a temperature of the fixing belt 57 that enters into a fixing nip area 43A to be stable and highly accurate, and further to shorten a time for warm-up on start up. Furthermore, since a controlled temperature is measured between the electrode sections 48, it is possible to control heating while the fixing belt 57 is being stopped. This allows heat to be retained during a standby state of the image forming apparatus, so that it is possible to start the image forming operation from the standby state in a short period of time.

Further, in the present embodiment, the heat-generating layer 55 generates heat even in a part, in the thin fixing belt 57, which does not have contact with the support rollers 51 and 52 as the support members. From this reason, a temperature drastically increases in this part of the fixing belt 57, compared with parts, in the fixing belt 57, which have contact with the support rollers 51 and 52. On this account, in a case where a heat control is carried out based on temperature detection at the part that has contact with the support rollers 51 and 52, a temperature becomes too high and may exceed an allowable temperature limit of the fixing belt 57 in a part of the fixing belt 57 that is suspended between the support rollers 51 and 52. In this regard, in the present embodiment, the temperature detecting means 38A for detecting the temperature of the fixing belt 57 is provided so as to face the part of the fixing belt 57 that is suspended between the support rollers 51 and 52. Accordingly, this makes it possible to carry out the heat control based on temperature detection at the part suspended between the support rollers 51 and 52 in which part a temperature drastically varies. Consequently, it is possible to prevent that the temperature becomes too high and exceeds the allowable temperature limit in the part suspended between the support rollers 51 and 52. Accordingly, this makes it possible to obtain a stable and high-quality fixed image over a long period.

The fixing belt 57 has the small heat capacity and a high control response. This makes it possible to maintain a temperature of the fixing belt 57 that enters into the fixing nip area 43A to be stable and highly accurate, and further to shorten a time required for warm-up on start up. Furthermore thus controlled temperature is measured between the electrified electrode sections, so that it is possible to control heating while the fixing belt 57 is being stopped. This allows heat to be retained during a standby state of an image forming apparatus, so that an image forming operation can be started from the standby state in a short period of time.

In the present embodiment, not only the A3-size recording paper, but various recording papers having a plurality of widths, such as an A4 vertical-size paper, a B4-size paper, a B5 vertical-size paper, and the like can be used. The following explains about an advantageous effect of the present embodiment in a case where an A4 vertical-size paper passes, with reference to FIG. 9.

Figure 9:
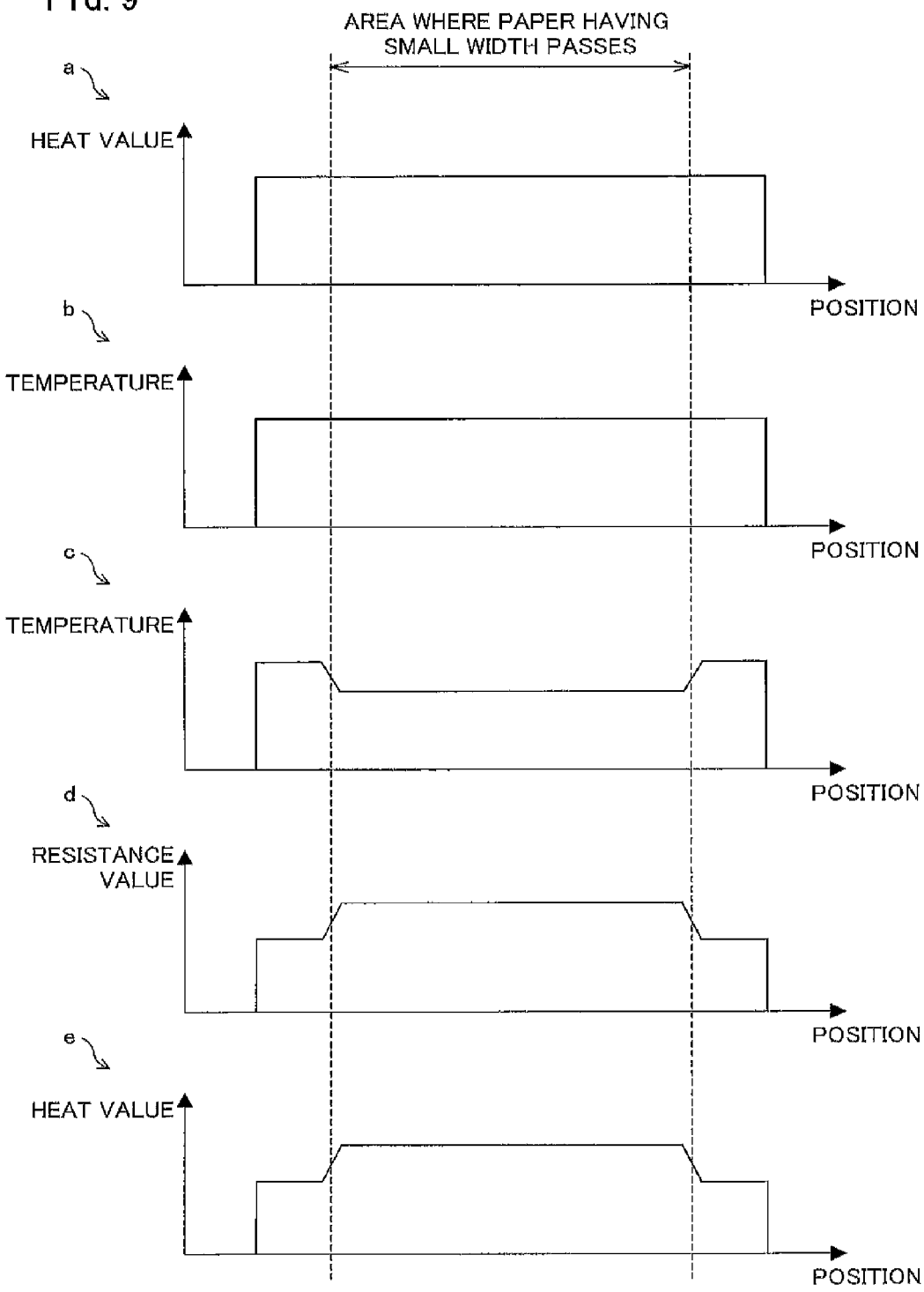
FIG. 9 shows distributions of heat values, temperatures, and a resistance value, each in a part between electrode sections in a heat-generating layer in a width direction and in an area where a recording paper passes, in an outer surface of the fixing roller according to Embodiment 2 of the present invention.

In FIG. 9, a graph a shows a heat generation distribution of the heat-generating layer 55 in a width direction (in a direction parallel to an axial direction of the first support roller 51), which distribution is before a recording paper P passes. A graph b shows a temperature distribution of the heat-generating layer 55 in the width direction, which distribution is before the recording paper P passes. A graph c shows a temperature distribution of the heat-generating layer 55 in the width direction, which distribution is after the recording paper P passed. A graph d shows a resistance distribution of the heat-generating layer 55 in the width direction, which distribution is after the recording paper P passed. A graph e shows, in the width direction, a heat generation distribution of the heat-generating layer 55 that is electrified so as to have the resistance distribution shown in the graph d.

As shown in the graph a of FIG. 9, the heat generation distribution is substantially uniform in the width direction of the heat-generating layer 55 before a recording paper P passes. Since heat values of the heat-generating layer 55 are uniform in the width direction as such, the temperature distribution is substantially uniform as shown in the graph b of FIG. 9. When the recording paper P passes through the fixing apparatus 40A, heat does not shift from the fixing belt 57 to the recording paper P in areas where the recording paper P does not pass (both ends of the fixing belt), but heat shifts from the fixing belt 57 to the recording paper P in an area where the recording paper P passes (a center of the fixing belt). From this reason, a temperature in the area where the recording paper P passed decreases as shown in the graph c of FIG. 9. In the present invention, the heat-generating layer 55 is a heating element having the NTC characteristic. On this account, in a case where such the temperature distribution occurs, a resistance value becomes low in a part where the temperature is high and a resistance value becomes high in a part where the temperature is low, as shown in the graph d of FIG. 9. As schematically illustrated in FIG. 5, this status is a series connection circuit in which the part where the temperature is relatively high and the resistance value is low (a high-temperature and low-resistance part) is connected in series with the part where the temperature is relatively low and the resistance value is high (a low-temperature and high resistance part). That is, in this status, the same current flows into the high-temperature and low-resistance part and the low-temperature and high-resistance part. In this case, when a temperature control is carried out by a temperature sensor for controlling a temperature provided in the area where the recording paper P passes, it is possible to cause the heat value to be relatively low in the high-temperature and low-resistance part, compared with the low-temperature and high-resistance part, as shown in the graph e of FIG. 9. This can decrease unevenness in temperature caused in the width direction, and prevent that the temperature becomes too high at the both ends of the fixing belt 57.

On the other hand, in a case where a current is applied parallel to the carrying direction of the recording paper P, the current flows into a parallel circuit in which the high-temperature and low-resistance part at the both ends of the fixing belt is electrically connected in parallel with the low-temperature and high-resistance part at the center of the fixing belt. In this case, more current is caused to flow into the high-temperature and low-resistance part, thereby resulting in that the temperature in the high-temperature and low-resistance part further increases and unevenness in temperature becomes more significant. The unevenness in temperature may cause the temperature to exceed an allowable temperature limit of constituent members for fixing. Further, in order that increase in temperature is restrained at the both ends of the fixing belt, it is necessary to largely decrease throughput of narrow-width recording papers.

In the arrangement of the present embodiment, since the heat-generating layer 55 has a wider length, in a width direction perpendicular to the carrying direction, than a maximum width of a recording paper to be used. This allows the heat-generating layer 55 to uniformly heat an area where the recording paper having the maximum width passes, so that the temperature in that area has a predetermined temperature. Consequently, the arrangement makes it possible to obtain a uniform and high-quality fixed toner image. Further, a temperature sensor for a temperature control is provided in an area where a recording paper P passes, that is, an area where all the recording papers P having different widths pass. This makes it possible to directly control a temperature in the area where the recording paper P passes, with high accuracy. Consequently, it is possible to stably obtain a high-quality fixed image.

Further, the electrode sections 48 are provided in the entire circumferential direction, so that a whole area of the heat-generating layer can uniformly generate heat, thereby causing no unevenness in heat in the circumferential direction and realizing a uniform temperature distribution in the circumferential direction.

Moreover, in the arrangement, the heat-generating layer 55 is provided in the thin fixing belt 57. This shortens a heat conduction distance from the heat-generating layer 55 to a surface of the releasing layer 56, which surface is a fixing surface that comes into contact with a toner image. As a result, a temperature controllability according to heat generated from the heat-generating layer 55 is improved in the surface of the fixing belt 57, so that the temperature of the surface of the fixing belt 57 can be controlled with higher accuracy. This allows a fixed toner image to be more uniform and higher quality.

Generally, in a case of a heat-generating member such as a belt having a low heat capacity, a short heat conduction distance, and a high heat response, unevenness in temperature is significant between the area where the recording paper P passes and the areas where the recording paper P does not pass. However, in the present embodiment, a current is applied to the heat-generating layer 55 having the NTC characteristic, in a direction perpendicularly to the carrying direction of the recording paper P. This can prevent that a temperature excessively increases in the areas where the recording paper P does not pass.

Furthermore, the releasing layer 56 is provided on an outer surface of the heat-generating layer 55, which surface comes into contact with a toner image. This can prevent that a toner adheres to the fixing belt 57.

The electrode sections 48 are respectively provided on outer surfaces in close proximity to both ends of the heat-generating layer 55, in a width direction, the electrode sections 48 being connected to the heat-generating layer 55. That is, the electrode sections 48 are respectively provided in close proximity to both ends of the fixing belt 57. No releasing layer is provided on the electrode sections 48 so that a current is supplied to the electrode sections 48 from a main body of an image forming apparatus. This allows the current to flow in the heat-generating layer 55 of the fixing belt 57 in a direction perpendicular to the carrying direction of the recording paper, i.e., an axial direction of the fixing belt 57. As such, in the present invention, an entire direction of the current flowing in the heat-generating layer 55 is substantially perpendicular to the carrying direction. This can restrain occurrence of unevenness in temperature in the width direction, thereby making it possible to obtain a uniform and high-quality fixed toner image.

Furthermore, generally, an electric resistance of a heat-generating layer is changed due to attrition of the heat-generating layer, and this may cause unevenness in temperature. However, in the present embodiment, a releasing layer is provided on an outer surface of the heat-generating layer 55, which surface comes into contact with a toner image. This makes it possible to prevent that a toner adheres to the fixing belt 57 and the heat-generating layer 55 is worn away. As a result, it is possible that the heat-generating layer 57 stably and uniformly generates heat over a long period.

Moreover, since a power is supplied to the electrode sections 48 in a part, in the fixing roller 57, wound around the first support roller 51, the electrodes have stable contact with the electric contact points. This can realize stable and uniform heat generation over a long period.

In the present embodiment, polyimide that is a heat-resistance resin is used for the substrate 53 of the fixing belt 57, but a thin metal belt made from stainless, nickel, or the like, may be also used. In this case, it is necessary to provide an insulating layer between the substrate 53 and the heat-generating layer 55.

Further, as has been already described, the arrangement of the present embodiment is such that a backup roller made from sponge that forms the fixing nip area 43A is provided as the second support roller, and an area where the fixing belt 57 comes into contact with the pressure roller 42 according to pressure from the second support roller 52 serves as a fixing nip. However, the present embodiment is not limited to the arrangement, and can be applicable to an arrangement in which the second support roller 52 is a hard roller made from stainless similarly to the first support roller 51, and a part of the fixing belt 57 suspended between the support rollers is arranged to have contact with the pressure roller 42 so that the part serves as a fixing nip. In this case, neither the first support roller 51 nor the second fixing roller 52 is pressured to the pressure roller.

Embodiment 3

In the present embodiment, in order to explain different points from Embodiments 1 and 2, members having the same functions as those explained in Embodiments 1 and 2 have the same referential numerals, are not explained in the present embodiment.

Figure 10:
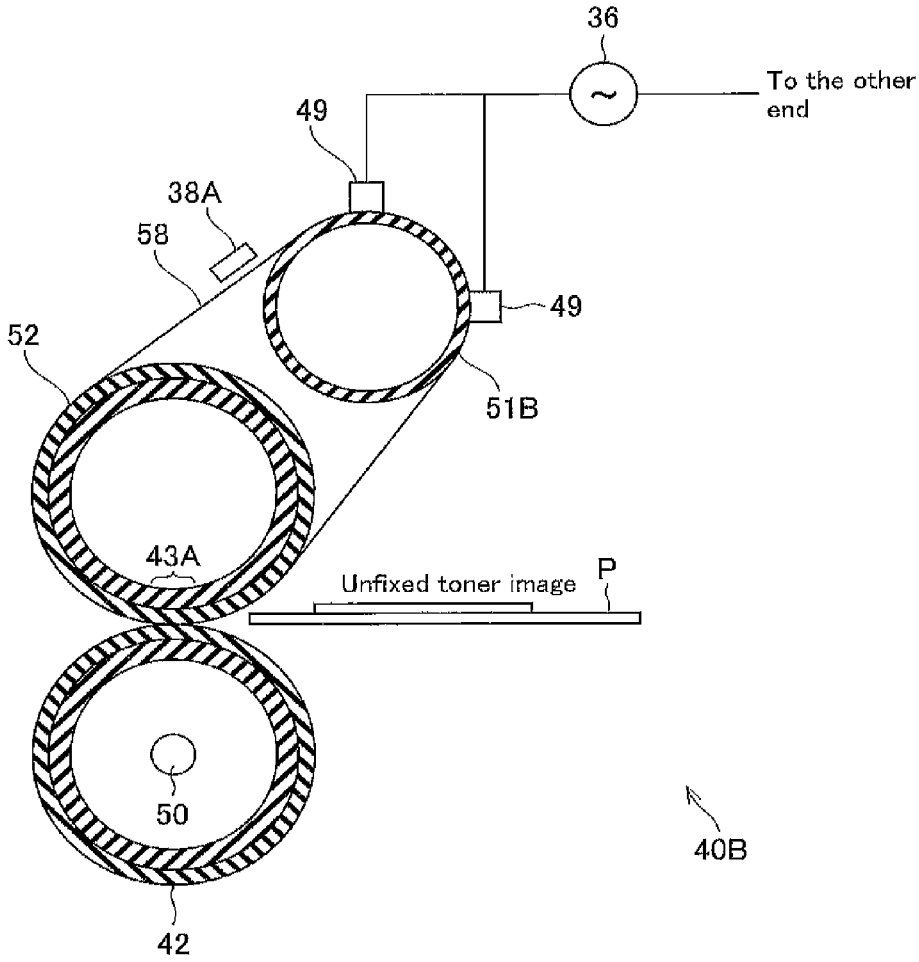
FIG. 10 is a cross sectional view illustrating an arrangement of a fixing apparatus in an axial direction of a fixing belt, according to Embodiment 3 of the present invention.
Figure 11:
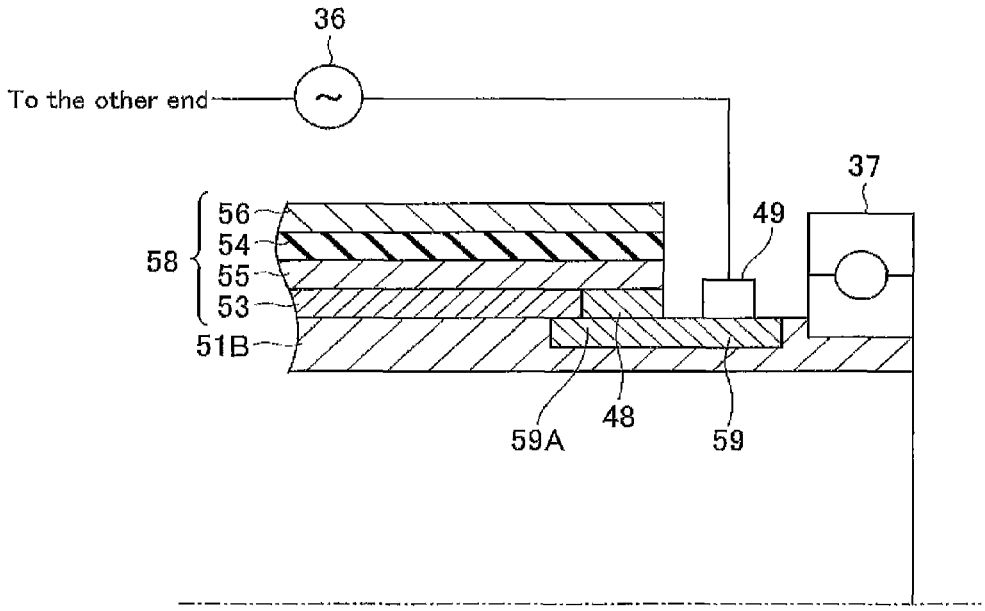
FIG. 11 is a cross sectional view illustrating an end of the fixing belt, including an axis, according to Embodiment 3 of the present invention.

Explained with reference to FIGS. 10 and 11 is a fixing apparatus 40B that is applied to a color image forming apparatus.

FIG. 10 is a cross sectional view illustrating an arrangement of the fixing apparatus 40B in an axial direction of a fixing belt 58, and FIG. 11 is a cross sectional view illustrating an end of the fixing belt 58, including an axis.

The present embodiment is different from Embodiment 2 in how to supply a power to a heat-generating layer 55. More specifically, in Embodiment 2, the fixing belt 57 is arranged such that the substrate 53, the insulating layer 54, the heat-generating layer 55, and the releasing layer 56 are laminated in this order from inside, and the electrode sections 48 are provided on respective outer surface sides in close proximity to both ends of the heat-generating layer 55 in a width direction so that the electrode sections 48 are connected to the heat-generating layer 55. On the other hand, the fixing belt 58 is arranged such that a substrate 53, a heat-generating layer 55, an insulating layer 54, and a releasing layer 56 are laminated in this order from inside. Electrode sections 48 are provided on respective inner surface sides in close proximity to both ends of the heat-generating layer 55 in a width direction, the electrode section 48 being connected to the heat-generating layer 55. A power is supplied to a respective of the electrode sections 48 provided in close proximity to the both ends of the heat-generating layer 55 in the width direction so that a current flows between the electrode sections 48.

Further, a noncontact thermistor 38A is provided, as temperature detecting means, so as to face a part of a peripheral surface of the fixing belt 58, which part of the peripheral surface is suspended between support rollers 51B and 52. The noncontact thermistor 38A controls a power supplied to the heat-generating layer 55 so that a temperature of the peripheral surface of the belt is maintained at 190° C. during image forming operation.

Moreover, the releasing layer 56 entirely covers the outer surface of the fixing belt 58. Further, a first support roller 51B is made from an insulating material such as PPS, and parts in the both ends of the first support roller 51B, which parts come into contact with the electrode sections 48, are constituted by power feeding electrodes (power supplying members) 59 made from a good conductor such as copper, each of which power feeding electrodes 59 is connected to a heteropolar power supply. Each of the power feeding electrodes 59 includes a power supplying section 59A that comes into contact with each of the electrode sections 48 of the fixing belt 58. Other arrangements except for the fixing apparatus are the same as those in Embodiment 1.

In the fixing apparatus of the present embodiment, the electrode sections 48 are provided on the respective inner surface sides in close proximity to the both ends of the fixing belt 58, and the electrode sections 48 are connected to the heat-generating layer 55. A current is supplied to the electrode sections 48 so that the current can flow, in the heat-generating layer of the fixing belt, in an axial direction of the belt, perpendicular to a carrying direction of a recording paper.

As such, in the present embodiment, the current flows, in the heat-generating layer 55, entirely in the direction substantially perpendicular to the carrying direction, thereby resulting in that unevenness in temperature in the width direction is restrained and a uniform and high-quality fixed toner image can be obtained. Further, the electrode sections are provided on an inner surface side of the fixing belt. This can prevent that a toner or a floating toner on a recording paper adheres to the electrodes sections, thereby resulting in that a main body can stably supply a power to the fixing belt.

Furthermore, generally, an electric resistance of a heat-generating layer is changed due to attrition of the heat-generating layer, and this may cause unevenness in temperature. However, in the present embodiment, a substrate is provided on an outer side of the heat-generating layer 55 in the inner surface of the fixing belt 58, so that the heat-generating layer 55 can be prevented from being worn away, with the result in that the heat-generating layer 55 can stably and uniformly generate heat over a long period.

Further, each of the power supplying members 59, which comes into contact with each of the electrode sections 48 provided on the inner surface of the fixing belt 58 and rotates with a rotation of the fixing belt 58, includes the power supplying section 59A that has contact with the electrode section 48 of the fixing belt and supplies a power to the electrode section 48. This allows the electrode section 48 to receive a power without sliding in contact with the power supplying section 59A, thereby resulting in that the electrode section 48 and the power supplying section 59A can be prevented from being worn away, so that the power supplying section 59A can stably supply a current to the electrode section 48 over a long period.

Note that it is preferable to form a power supplying section at each end of the first support roller (a part where electric contact points 49 have contact with the power supplying member 59) so as to be unleveled by sand blast or the like. This increases local pressure and ensures electric contact.

Further, a noncontact thermistor 38A is provided, as temperature detecting means, so as to face a part of an outer surface of the fixing belt 58, which part is suspended between the support rollers 51B and 52, and a power supplied to the heat-generating layer 55 is controlled so that a temperature is maintained at 190° C. in the outer surface of the belt during the image forming operation. The fixing belt has a small heat capacity and a high control response. This makes it possible to maintain a temperature of the fixing belt 58 that enters into the fixing nip area 43A to be stable and highly accurate, and further to shorten a time required for warm-up on start up. Furthermore, thus controlled temperature is measured between the electrode sections 48, so that it is possible to control heating while the fixing belt 58 is being stopped, to retain temperature during a standby state of an image forming apparatus, and to start the image forming operation from the standby state in a short period of time.

Further, in the present embodiment, since the heat-generating layer 55 in a part of the thin fixing belt 58 that does not have contact with the support rollers 51B and 52 as the support members, also generates heat, a temperature drastically increases in the part of the fixing belt 58 compared with a part of the fixing belt 58 that has contact with the support rollers 51B and 52. On this account, in a case where a heat control is carried out based on temperature detection at the part that has contact with the support rollers 51B and 52, the temperature becomes too high in a part of the fixing belt 58 that is suspended between the support rollers 51B and 52 and the temperature may exceed an allowable temperature limit of the fixing belt 58. In the present embodiment, the temperature detecting means 38A for detecting the temperature of the fixing belt 58 is provided so as to face the part of the fixing belt 58 that is suspended between the support rollers 51B and 52. This makes it possible to carry out the heat control based on temperature detection at the part suspended between the support rollers 51B and 52, in which part a temperature drastically varies. Consequently, it is possible to prevent that the temperature becomes too high and exceeds the allowable temperature limit of the fixing belt 58 in the part suspended between the support rollers 51B and 52. Accordingly, this makes it possible to obtain a stable and high-quality fixed image over a long period.

Embodiment 4

In the present embodiment, in order to explain different points from Embodiment 3, members having the same functions as those explained in Embodiment 3 have the same referential numerals, and are not explained in the present embodiment.

Figure 12:
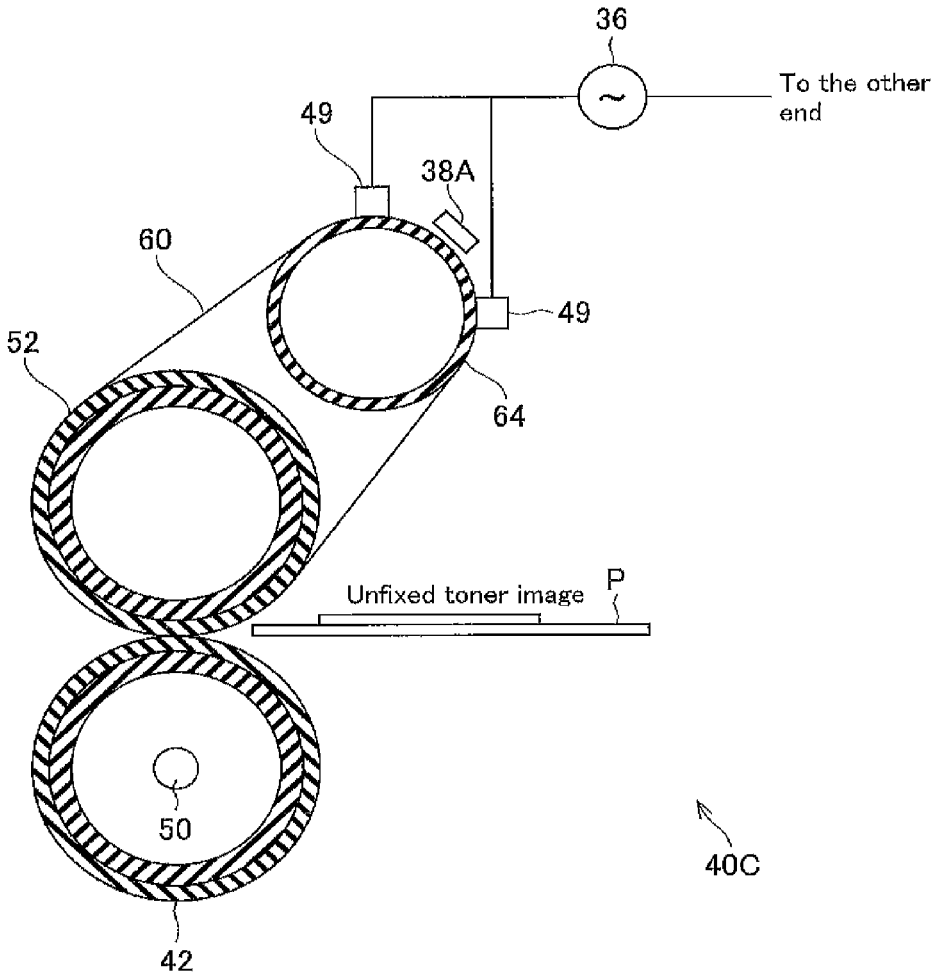
FIG. 12 is a cross sectional view illustrating an arrangement of a fixing apparatus in an axial direction of a fixing belt, according to Embodiment 4 of the present invention.
Figure 13:
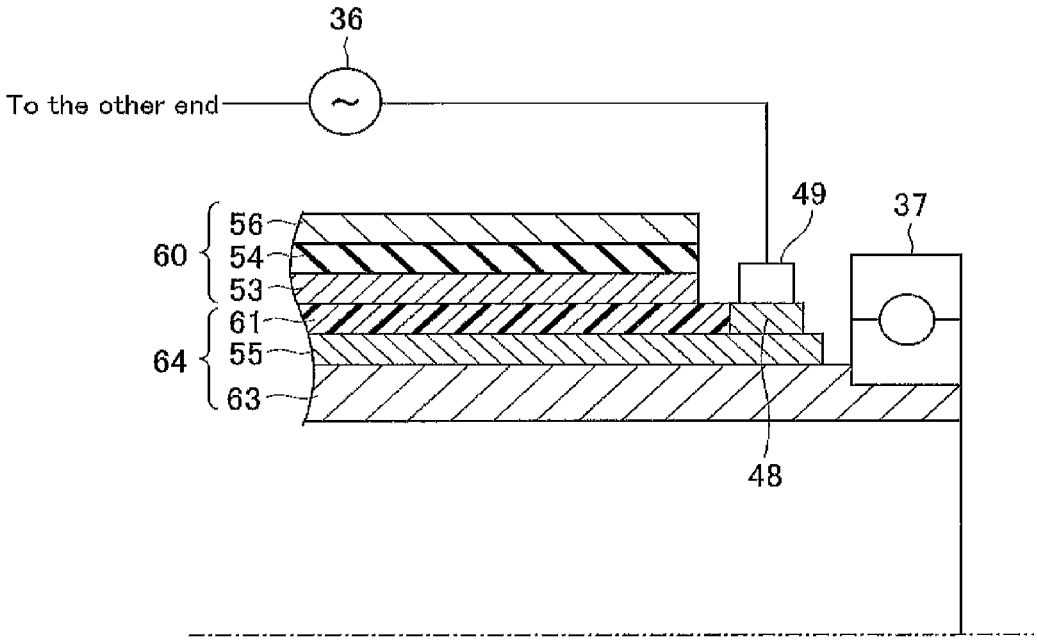
FIG. 13 is a cross sectional view illustrating an end of the fixing belt, including an axis, according to Embodiment 4 of the present invention.

Explained with reference to FIGS. 12 and 13 is a fixing apparatus 40C that is applied to a color image forming apparatus.

FIG. 12 is a cross sectional view illustrating an arrangement of the fixing apparatus 40C in an axial direction of a fixing belt 60, and FIG. 13 is a cross sectional view illustrating an end of the fixing belt 60, including an axis.

The present embodiment is different from Embodiment 3 in that no heat-generating layer is provided in the fixing belt 60 and a heat-generating layer 55 is provided in a heat-generating roller 64 that is a first support roller. Electrode sections 48 are provided on respective outer surface sides in close proximity to both ends of the heat-generating layer 55 in a width direction, and the electrode sections 48 are connected to the heat-generating layer 55. A power is supplied to the electrode sections 48 respectively provided in close proximity to the both ends of the heat-generating layer 55 in the width direction, so that a current flows between the electrode sections 48. Other arrangements except for the above members are the same as those in Embodiment 3.

The heat-generating roller (heating member) 64 is arranged such that the heat-generating layer 55 having a thickness of 200 μm is provided on a PPS pipe 63, as a substrate, having a thickness of 100 μm, and a protection layer 61 made from a fluorine resin is further provided thereon so as to have a thickness of 30 μm. The electrode sections 48 made from a good conductor such as copper are respectively provided in close proximity to both ends of the heat-generating roller 64, and a plurality of power supply electrodes for supplying a power are provided so as to slide in contact with the electrode sections 48.

In this arrangement, the heat-generating layer 55 is provided on an outer side of the substrate in the roller that comes into contact with an inner surface of the thin fixing belt. This shortens a heat conduction distance from the heat-generating layer 55 to a surface of the fixing belt 60, which surface is a fixing surface that comes into contact with a toner image. As a result, a temperature controllability according to heat generated from the heat-generating layer 55 is improved in the surface of the fixing belt, so that the temperature of the surface of the fixing belt 57 can be improved with higher accuracy. This makes it possible to maintain the temperature of the fixing belt at a predetermined temperature. As a result, a more uniform and higher quality fixed toner image can be obtained.

Further, in the arrangement of the present embodiment, a thin fixing belt does not include a heat-generating layer 55 but the heat-generating layer 55 is provided in the heat-generating roller 64. This can prevent that the heat-generating layer is cracked or deteriorated due to flection fatigue caused by rotation of the fixing belt 60. As a result, it is possible to stably generate heat over a long period.

In the present embodiment, a temperature sensor 38A is also provided at a center of the heat-generating layer, i.e., above an area where a recording paper passes. The fixing belt 60 is driven to rotate with a rotation of a second support roller 52 and comes into contact with the recording paper. The fixing belt 60 is set to have a wider length, in a width direction, than a maximum width of the recording paper so that vicinities of both ends of the fixing belt 60 do not come into contact with the recording paper. In the fixing belt 60, an area that can come into contact with the recording paper is taken as an area where the recording paper passes. In the present embodiment, an area, in the heat-generating layer 55, where the recording paper passes indicates an area facing the area, in the fixing belt 60, where the recording paper passes. In other words, the area in the heat-generating layer 55 overlaps the recording paper when the recording paper is carried in parallel in a normal line direction and a carrying direction of the recording paper. This allows a stable temperature control of the heat-generating layer 55.

Embodiment 5

In the present embodiment, in order to explain different points from Embodiment 4, members having the same functions as those explained in Embodiment 4 have the same referential numerals, and are not explained in the present embodiment.

Figure 14:
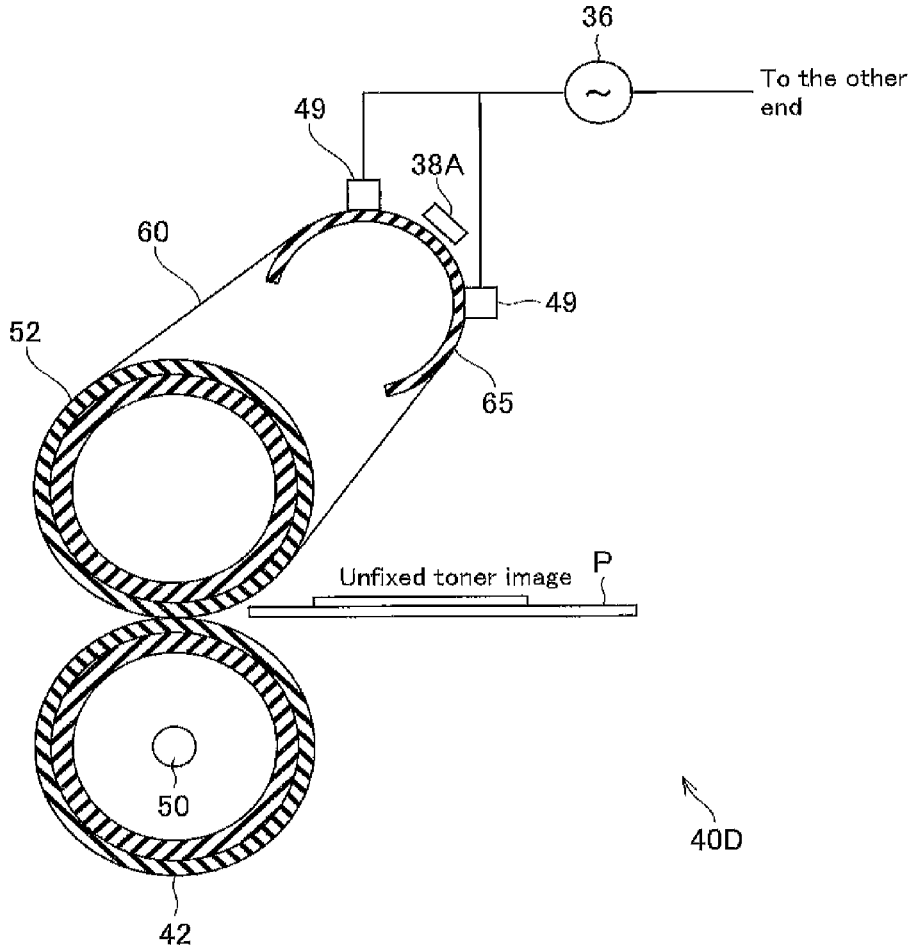
FIG. 14 is a cross sectional view illustrating an arrangement of a fixing apparatus in an axial direction of a fixing belt, according to Embodiment 5 of the present invention.
Figure 15:
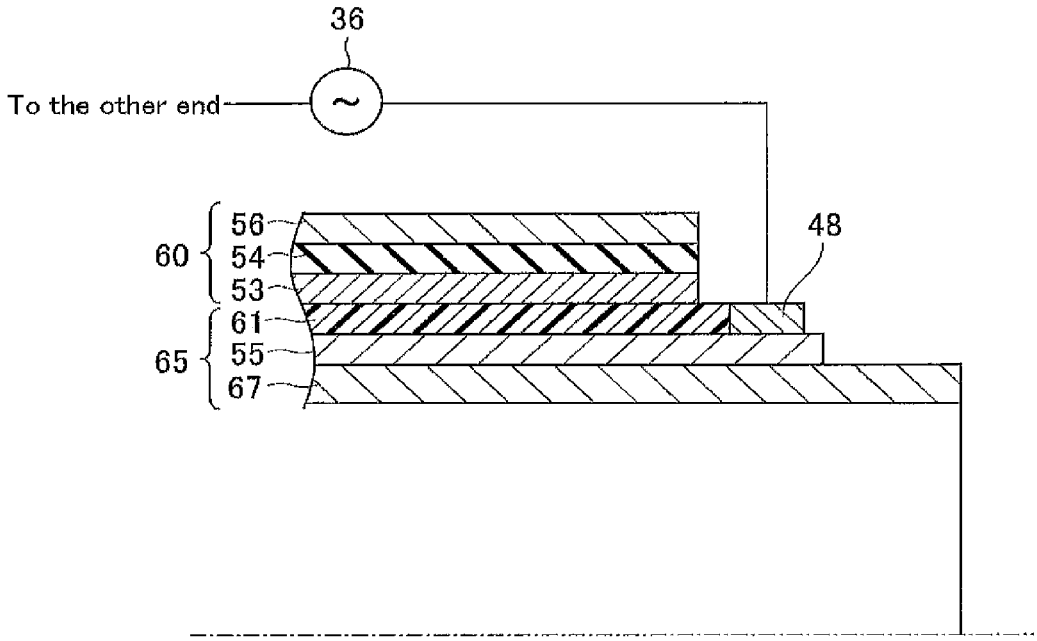
FIG. 15 is a cross sectional view illustrating an end of the fixing belt, including an axis, according to Embodiment 5 of the present invention.

Explained with FIGS. 14 and 15 is a fixing apparatus 40D that is applied to a color image forming apparatus.

FIG. 14 is a cross sectional view illustrating an arrangement of the fixing apparatus 40D in an axial direction of a fixing belt 60, and FIG. 15 is a cross sectional view illustrating an end of the fixing belt 60, including an axis.

The present embodiment is different from Embodiment 4 in that a heat-generating member as a support member is constituted by a heating member 65 that is not in a roller shape but has a substantially half-round cross section with a central angle of about 240°, which cross section is perpendicular to an axial direction of the support roller 52. The heating member 65 is a fixation that has contact with an inner surface of the fixing belt 60 and suspends the fixing belt 60, and does not rotate. Other arrangements except for the member are the same as those in Embodiment 4.

The heating member 65 as a support member is arranged such that a heat-generating layer 55 having a thickness of 200 μm is provided on a substrate 67 that is a half-round PPS pipe having a thickness of 100 μm, and further a protection layer 61 made from a fluorine resin is provided thereon so as to have a thickness of 30 μm. Electrode sections 48 made from a good conductor such as copper are respectively provided in close proximity to both ends of the heating member 65, and a plurality of electric contact points 49 for supplying power are fixed on each of the electrode sections 48. The both ends of the heating member 65 are connected to different electrodes of a power supply so that a power is supplied, in an axial direction, to the heat-generating layer 55 that is made from a resistive of the half-round pipe. The fixing belt 60 is heated such that the fixing belt 60 slides in contact with the protection layer 61 that is made from a fluorine resin and provided on a surface of the heating member 65.

Since the heating member 65 does not rotate, an area where a power is supplied from a main body of the image forming apparatus to the heat-generating layer, does not have any parts that slide in contact with the electric contact points.

Further, an electric resistance of a heat-generating layer is changed due to attrition of the heat-generating layer, and this may cause unevenness in temperature. However, in the present embodiment, the protection layer 61 is provided on an outer side of the fixing element 55, that is, the protection layer 61 is provided as an outer surface of the heating member 65 that comes into contact with the fixing belt. This can prevent attrition of the heat-generating layer even if the heating member 65 slides in contact with the fixing belt 60, thereby resulting in that it is possible to stably and uniformly generate heat over a long period.

Furthermore, in the arrangement, the heating member 65 comes into contact with an inner surface of the fixing belt 60, thereby allowing a contact area, in a rotational direction, of the fixing belt 60 with the heating member 65 to be longer.

This makes it possible to promote heat conduction from the heating member 65 to the fixing belt 60.

The above embodiments use a carrying belt for carrying a paper. However, a method for forming an unfixed image on a paper is not limited to this, and can be similarly realized by an arrangement in which an intermediate transfer belt is used or a one-color arrangement in which an image is transferred from a photo conductor to a recording paper.

Moreover, as has been described above, the above embodiments are arranged such that after a toner image is electrostatically transferred onto a recording paper, the toner image is pressed and heated by a fixing apparatus so as to be fixed on the recording paper. However, the present invention is not limited to this, and can be similarly realized by a transfer and fixing arrangement in which a toner image is pressed and heated at the same time when the toner image is transferred onto a recording paper.

A fixing apparatus of the present invention is such that fixing an unfixed toner image on a recording paper to be carried in a predetermined carried direction is carried out by heat generated from a heating element that generates heat while a power is supplied thereto, and a power supplied to the heating element is controlled so that the heating element has a predetermined temperature during the fixing. The heating element has an NTC characteristic in which an electric resistance value decreases as a temperature increases, the heating element extends (i) in a direction parallel to the recording paper and (ii) in a width direction that is perpendicular to the carrying direction of the recording paper, and the heating element has a wider length, in the width direction, than a width of the recording paper. The fixing apparatus further includes electrode sections respectively provided in close proximity to both ends of the heating element in the width direction, the electrode sections being connected to the heating element, and the power is supplied to the heating element so that a current flows in a direction substantially perpendicular to the carrying direction.

When the recording paper passed through the fixing apparatus, since heat does not shift to the recording paper in an area where the recording paper does not pass, a temperature of the heating element increases in that area. In a temperature distribution caused in the heating element having the NTC characteristic, a resistance value becomes low in a part where a temperature is high. In this case, when a current is supplied, in a width direction, to the heating element having the NTC characteristic and such the temperature distribution, a part where the temperature is high and the resistance value is low (a high-temperature and low-resistance part) can be electrically connected in series with a part where the temperature is relatively low and the resistance value is high (a low-temperature and high-resistance part), as a series connection circuit. In this status, the same current flows into the high-temperature and low-resistance part and the low-temperature and high-resistance part. On this account, a heat value relatively decreases in the high-temperature and low-resistance part, compared with the low-temperature and high-resistance part. This can (i) decrease unevenness in temperature that is caused when the recording paper passes through the fixing apparatus, and (ii) prevent that a temperature becomes too high in both ends of the heating element (the areas where the recording paper does not pass).

Further, the heating element extends (i) in a direction parallel to the recording paper and (ii) in a width direction perpendicular to a carrying direction of the recording paper, and the heating element has a wider length, in the width direction, than a width of the recording paper. This makes it possible to uniformly heat the area where the recording paper passes, thereby resulting in that a uniform and high-quality fixed toner image can be obtained. Further, as has been already described, the current flows in the heating element entirely in a direction substantially perpendicular to the carrying direction, so that unevenness in temperature in the width direction can be restrained and a uniform and high-quality fixed toner image can be obtained.

In the fixing apparatus of the present invention, an unfixed toner image can be fixed to plural types of recording papers, each having a different width in a direction perpendicular to the carrying direction. The length of the heating element between the electrode sections in the width direction is wider than a maximum width among the plural types of the recording papers. Further, the heating element includes a temperature sensor is in an area where all the plural types of the recording paper pass, and it is preferable that the power supplied to the heating element is controlled in response to the temperature sensor.

In the arrangement, the length of the heating element between the electrode sections in the width direction is wider than the maximum width among the plural types of the recording papers. This makes it possible to heat, at a uniform temperature, an area where a recording paper having a maximum width passes, thereby resulting in that a uniform and high-quality fixed toner image can be obtained. Further, a temperature sensor for a temperature control is provided in the area where all the plural types of the recording papers pass, each of the recording papers having a different width. This makes it possible to directly control a temperature with high accuracy in the area where the recording paper passes, thereby resulting in that a high-quality fixed image can be stably obtained.

The area where the recording paper passes (a paper-passing area) is an area of the heating element that overlaps a recording paper when the recording paper is carried in a direction parallel to a normal line direction and/or a carrying direction of the recording paper.

The fixing apparatus of the present invention may include a pair of a fixing roller and a pressure roller that rotate so as to press to the recording paper bearing an unfixed toner image. In the fixing apparatus, the fixing roller is preferably arranged such that at least a metal core, the heating element in a layered form, and a releasing layer as a surface of the fixing roller are laminated.

That is, the fixing roller includes at least a metal core, a heating element in a layered form, and a releasing layer, and the releasing layer constitutes a surface of the fixing roller.

In the arrangement, the heating element is provided on an outer side of the metal core of the fixing roller, thereby shortening a heat conduction distance from the heating element to a surface of the releasing layer, which surface is a fixing surface that comes into contact with a toner image. Consequently, a temperature controllability according to heat generated from the heating element is improved in a surface of the fixing roller, and the temperature of the fixing roller can be maintained at a predetermined temperature. As a result, it is possible to form a more uniform and higher quality fixed toner image.

Generally, when a heat conduction distance is short and a heat response is high, unevenness in temperature easily becomes significant between the area where the recording paper passes and the both ends in the fixing roller.

However, with the above arrangement, since a current is applied to the heating element having the NTC characteristic in a width direction perpendicular to the carrying direction of the recording paper, it is possible to prevent excessive increase in temperature at the both ends of the fixing roller.

Further, the fixing roller includes the releasing layer on an outer side of the heating element, as that surface of the fixing roller which comes into contact with a toner image. This can prevent that a toner adheres to the fixing roller.

In the fixing apparatus of the present invention, the fixing roller may be arranged such that at least a metal core, an insulating layer, the heating element in a layered form, and a releasing layer as a surface of the fixing roller are laminated. In such the fixing apparatus, it is preferable that the electrode sections be provided on respective outer surface sides in close proximity to both ends of the heating element in a width direction, the electrode sections being connected to the heating element, and the releasing layer be not laminated on the electrode sections so that a current is supplied to the heating element via the electrode sections.

In a case where the heating element is made from a material having an electric resistance higher than that of a metal material, such as aluminum or iron, which is commercially available at a low price and has high strength, and the heating element has direct contact with the metal core, a current flows into not the heating element but the metal core, thereby resulting in that the heating element does not generate heat.

With the arrangement of the present invention, since the fixing roller is arranged such that an interlayer insulating layer is provided between the metal core and the heating element, it is possible to prevent that the current flows into the metal core even when a voltage is applied to the heating element, so that the heating element can generate heat. This makes it possible to form the metal core from the metal material, such as aluminum iron, which is commercially available at a low price and has high strength.

Further, the electrode sections are respectively provided on the outer surfaces in close proximity to the both ends of the heating element in the width direction, the electrode sections being connected to the heating element. The releasing layer is not laminated on the electrode sections so that a current is supplied to the heating element via the electrode sections. This makes it possible to cause the current to flow into the heating element having the NTC characteristic in the fixing roller in an axial direction of the roller, perpendicular to the carrying direction of the recording paper. As a result, it is possible to restrain unevenness in temperature in the heating element in the width direction, thereby resulting in that a uniform and high-quality fixed toner image can be obtained.

The fixing apparatus of the present invention may include a fixing belt that comes into contact with a surface of the recording paper on which surface an unfixed toner image is borne, a pressure member that is depressed by the fixing belt via the recording paper, and a plurality of support members that are provided inside the fixing belt and support the fixing belt. In such the fixing apparatus, it is preferable that the fixing belt include, at least, a substrate, the heating element in a layered form, and the releasing layer provided as a surface of the fixing belt.

In the arrangement, the fixing belt includes the heating element, and this shortens a heat conduction distance from the heating element to a surface of the releasing layer, which surface is a fixing surface that comes into contact with a toner image. As a result, a temperature controllability according to heat generated from the heating element is improved in a surface of the fixing belt, so that the temperature can be controlled with higher accuracy in the surface of the fixing belt. This makes it possible to maintain the temperature of the fixing belt at a predetermined temperature, thereby resulting in that a more uniform and higher-quality fixed toner image can be obtained.

Generally, in a case of a heat-generating member such as the above fixing belt, which has a low heat capacity, a short heat conduction distance, and a high heat response, unevenness in temperature easily becomes significant between the area where the recoding paper passes and the both ends of the heat-generating member. However, with the above arrangement of the present invention, since a current is applied to the heating element in a direction perpendicular to the carrying direction of the recording paper, it is possible to prevent that a temperature excessively increases at the both ends of the heating element.

Further, the fixing belt includes the releasing layer on an outer side of the heating element, as that surface of the fixing belt which comes into contact with a toner image. This can prevent that a toner adheres to the fixing belt.

Moreover, generally, an electric resistance of a heating element is changed due to attrition of the heating element, and this may cause unevenness in temperature. However, with the above arrangement of the present invention, since the fixing belt includes the releasing layer on the outer side of the heating element, that is, as that surface of the fixing belt which comes into contact with a toner image, it is possible to prevent that a toner adheres to the fixing belt, and to uniformly generate heat stably over a long period.

In the fixing apparatus of the present invention, it is preferable that the electrode sections be respectively provided on outer surfaces in close proximity to both ends of the heating element in a width direction, the electrode sections being connected to the heating element, and the releasing layer is not laminated on the electrode sections so that a current is supplied to the electrode sections.

With the arrangement, it is possible that a power is supplied to the heating element in the fixing belt so that a current flows in an axial direction of the belt, perpendicular to the carrying direction of the recording paper. Further, as has been already described, the current flows, in the heating element, entirely in a direction substantially perpendicular to the carrying direction. This can restrain unevenness in temperature in the width direction so that a uniform and high-quality fixed toner image can be obtained.

In the fixing apparatus of the present invention, it is preferable that the electrode sections be provided on respective inner surface sides in close proximity to both ends of the heating element in a width direction, the electrode sections being connected to the heating element.

In the arrangement, the electrode sections are provided on the respective inner surface sides in close proximity to the both ends of the heating element in the width direction, the electrode sections being connected to the heating element. This can prevent that a toner or a floating toner on a recording paper adheres to the electrode sections. As a result, it is possible to stably supply a power from a main body to the fixing belt.

Further, an electric resistance of the heating element is changed due to attrition of the heating element, and this causes unevenness in temperature. However, in the present invention, the releasing layer is provided on an outer side of the heating element in the inner surface of the fixing belt, so that the attrition of the heating element can be prevented. Consequently, it is possible to uniformly generate heat stably over a long period.

It is preferable that the fixing apparatus of the present invention include power supplying members respectively provided on outer surface sides at both ends of one of the plurality of the support members in a direction perpendicular to the carrying direction, the power supplying members respectively having contact with the electrode sections of the fixing belt and rotating with a rotation of the fixing belt.

In the arrangement, the fixing apparatus includes power supplying members respectively provided on the outer surface sides at the both ends of the support member in a direction perpendicular to the carrying direction such that the power supplying members have contact with the electrode sections of the fixing belt and rotate with a rotation of the fixing belt. This allows the electrode sections to receive a power without sliding in contact with the power supplying members. As a result, it is possible to prevent attrition of the electrode sections and the power supplying members, so that a current can be stably supplied over a long period.

The fixing apparatus of the present invention may include a fixing belt that comes into contact with a surface of the recording paper on which surface an unfixed toner image is borne, a pressure member that is depressed by the fixing belt via the recording paper, and a plurality of support members that are provided inside the fixing belt so as to support the fixing belt. It is preferable that one of the plurality of support members be a heating member including the heating element, the heating member including, at least, a substrate, the heating element in a layered form, and a protection layer so that they are laminated.

In the arrangement, the heating element is provided on an outer side of the substrate in the heating member that comes into contact with an inner surface of the fixing belt. This shortens a heat conduction distance from the heating element to a surface of the fixing belt, which surface is a fixing surface that comes into contact with a toner image. As a result, a temperature controllability according to heat generated from the heating element is improved in the surface of the fixing belt, so that the temperature can be controlled with higher accuracy in the surface of the fixing belt. This makes it possible to maintain a temperature of the fixing belt at a predetermined temperature, thereby resulting in that a more uniform and higher-quality fixed toner image can be obtained.

Further, with the arrangement, since the fixing belt includes no heating element, it is possible to prevent that the heating element is cracked or deteriorated due to flection fatigue caused by rotation of the fixing belt. This allows the heating element to stably generate heat for a long period.

In the fixing apparatus of the present invention, it is preferable that the heating member do not rotate, and a protection layer be provided on a surface of the heating member which surface comes into contact with the fixing belt such that the protection layer slides in contact with an inner surface of the fixing belt.

Since the heating member does not rotate, an area where a power is supplied to the heat element, does not have any parts that slide in contact with the electric contact points. This makes it possible to stably supply a power to the heating element over a long period.

Further, an electric resistance of the heating element is changed due to attrition of the heating element, and this causes unevenness in temperature. In the arrangement of the present invention, since the heating member includes a protection layer on the outer side of the heating element, as that surface of the heating member which comes into contact with the fixing belt. This can prevent the attrition of the heating element even when the heating member slides in contact with the fixing belt, thereby resulting in that the heating element can uniformly generate heat stably over a long period.

Further, the heating member has contact with the inner surface of the fixing belt. This makes it possible to form a long contact area of the fixing belt with the heating member in a rotational direction of the fixing belt, thereby making it possible to promote heat transfer from the heating member to the fixing belt.

An image forming apparatus of the present invention includes the fixing apparatus that fixes an unfixed toner image formed on a recording paper.

With the arrangement, it is possible to restrain unevenness in temperature of a heating element in a width direction, so that a uniform and high-quality fixed toner image can be obtained.

The present invention can be applied to an image forming apparatus including a fixing apparatus that is capable of forming a uniform and high-quality fixed image.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A fixing apparatus in which fixing is carried out by heat generated from a heating element while a power is being supplied thereto, and a power supplied to the heating element is controlled so that the heating element has a predetermined temperature during the fixing, said fixing apparatus comprising:

a fixing belt that comes into contact with a surface of a recording paper to be carried in a predetermined carrying direction, on which surface an unfixed toner image is borne;

a pressure member that is depressed by the fixing belt via the recording paper; and a plurality of support members provided inside the fixing belt so as to support the fixing belt, the fixing belt being provided with the heating element having an NTC characteristic in which an electric resistance value decreases as a temperature increases, the heating element extending (i) in a direction parallel to the recording paper and (ii) in a width direction perpendicular to the carrying direction of the recording paper, and the heating element having a longer length, in the width direction, than a width of the recording paper; wherein, the heating element rotates with the fixing belt, said fixing apparatus, further comprising:

electrode sections provided on respective inner surface sides in close proximity to both ends, in the width direction, of the heating element, the electrode sections being connected to the heating element, a current being supplied to the heating element so as to direct from one of the electrode sections toward the other one of the electrode sections provided on the respective inner surface sides in close proximity to the both ends.

2. The fixing apparatus as set forth in claim 1, further comprising:

power supplying members respectively provided on outer surface sides of both ends of one of the plurality of the support members, the power supplying members having contact with the fixing belt and rotating with a rotation of the fixing belt.

3. The fixing apparatus as set forth in claim 2, wherein:

a power supplying member makes contact with and extends between each an electrode sections and an electric contact point connected to a power supply.

4. The fixing apparatus as set forth in claim 1, wherein:
the unfixed toner image is capable of being fixed to plural types of recording papers, each having a different width in a direction perpendicular to the carrying direction,
the length of the heating element between the electrode sections in the width direction is wider than a maximum width among the plural types of recording papers, and
a temperature sensor is provided in an area where all the plural types of the recording papers pass, the power supplied to the heating element being controlled in response to the temperature sensor.

5. The fixing apparatus as set forth in claim 1, wherein:
the power is supplied to the heating element so that a current flows in a direction substantially perpendicular to the carrying direction.

6. An image forming apparatus comprising a fixing apparatus, in which fixing is carried out by heat generated from a heating element while a power is being supplied thereto, and a power supplied to the heating element is controlled so that the heating element has a predetermined temperature during the fixing,
said fixing apparatus including
a fixing belt that comes into contact with a surface of a recording paper to be carried in a predetermined carrying direction, on which surface an unfixed toner image is borne;
a pressure member that is depressed by the fixing belt via the recording paper; and
a plurality of support members provided inside the fixing belt so as to support the fixing belt,
the fixing belt being provided with the heating element having an NTC characteristic in which an electric resistance value decreases as a temperature increases, the heating element extending (i) in a direction parallel to the recording paper and (ii) in a width direction perpendicular to the carrying direction of the recording paper, and the heating element having a longer length, in the width direction, than a width of the recording paper; wherein, the heating element rotates with the fixing belt, said fixing apparatus, further including:
electrode sections provided on respective inner surface sides in close proximity to both ends, in the width direction, of the heating element, the electrode sections being connected to the heating element,
a current being supplied to the heating element so as to direct from one of the electrode sections toward the other one of the electrode sections provided on the respective inner surface sides in close proximity to the both ends.

7. The fixing apparatus as set forth in claim 1, wherein:
the fixing belt is suspended between the plurality of support members.

8. The fixing apparatus as set forth in claim 1, wherein:
the fixing belt includes a substrate layer that makes contact with the plurality of support members, heating element layer, including the heating element, formed on an outer surface of the substrate layer, an insulating layer formed on an outer surface of the heating element layer, and a releasing layer, formed on an outer surface of the insulating layer, that makes contact with the surface of the recording paper.

9. The fixing apparatus as set forth in claim 6, wherein:
the fixing belt is suspended between the plurality of support members.

10. The fixing apparatus as set forth in claim 6, wherein:
the fixing belt includes a substrate layer that makes contact with the plurality of support members, heating element layer, including the heating element, formed on an outer surface of the substrate layer, an insulating layer formed on an outer surface of the heating element layer, and a releasing layer, formed on an outer surface of the insulating layer, that makes contact with the surface of the recording paper.

11. A fixing apparatus in which fixing is carried out by heat generated from a heating element while a power is being supplied thereto, and a power supplied to the heating element is controlled so that the heating element has a predetermined temperature during the fixing, said fixing apparatus comprising:
a fixing belt that comes into contact with a surface of a recording paper to be carried in a predetermined carrying direction, on which surface an unfixed toner image is borne;
a pressure member that is depressed by the fixing belt via the recording paper; and
a plurality of support members provided inside the fixing belt so as to support the fixing belt,
the fixing belt being provided with the heating element having an NTC characteristic in which an electric resistance value decreases as a temperature increases, the heating element extending (i) in a direction parallel to the recording paper and (ii) in a width direction perpendicular to the carrying direction of the recording paper, and the heating element having a longer length, in the width direction, than a width of the recording paper; wherein, the heating element rotates with the fixing belt,
said fixing apparatus, further comprising:
electrode sections provided on respective outer surface sides in close proximity to both ends, in the width direction, of the heating element, the electrode sections being connected to the heating element,
a current being supplied to the heating element so as to direct from one of the electrode sections toward the other one of the electrode sections provided on the respective outer surface sides in close proximity to the both ends.

12. The fixing apparatus as set forth in claim 11, wherein:
the unfixed toner image is capable of being fixed to plural types of recording papers, each having a different width in a direction perpendicular to the carrying direction,
the length of the heating element between the electrode sections in the width direction is wider than a maximum width among the plural types of recording papers, and
a temperature sensor is provided in an area where all the plural types of the recording papers pass, the power supplied to the heating element being controlled in response to the temperature sensor.

13. The fixing apparatus as set forth in claim 11, wherein:
the power is supplied to the heating element so that a current flows in a direction substantially perpendicular to the carrying direction.

* * * * *